US005136341A

United States Patent [19]

Takemura et al.

[11] Patent Number: 5,136,341

[45] Date of Patent: Aug. 4, 1992

[54] IMAGE FORMING APPARATUS HAVING MEANS FOR COORDINATING THE INPUT AND DISCHARGE OF COPY PAPER

[75] Inventors: Yoshinobu Takemura, Nara; Kazuhiro Morimoto, Osaka; Yasuyuki Hirai, Yao; Masahiro Higashitani, Osaka; Mitsuru Adachi, Settsu; Yasuhiro Matsuo, Osaka; Shingo Mori, Nara; Yasuyuki Ishiguro, Osaka; Hidehiro Tabuchi, Sakai; Yoshihisa Tanaka, Higashiosaka; Hiromi Sakata, Nara; Tadashi Fujioka, Toyonaka; Kouji Ujino, Higashiosaka, all of Japan

[73] Assignee: Mita Industrial Co. Ltd., Osaka, Japan

[21] Appl. No.: 357,353

[22] Filed: May 26, 1989

[30] Foreign Application Priority Data

| | | | |
|---|---|---|---|
| May 31, 1988 | [JP] | Japan | 63-134806 |
| Jul. 8, 1988 | [JP] | Japan | 63-171561 |
| Jul. 20, 1988 | [JP] | Japan | 63-181182 |
| Jul. 29, 1988 | [JP] | Japan | 63-101740[U] |

[51] Int. Cl.[5] ..... G03G 21/00; B65H 5/22; B65H 3/44

[52] U.S. Cl. ..... 355/311; 271/3; 271/9; 355/323

[58] Field of Search ..... 355/308, 309, 311, 321, 355/323; 271/4, 9

[56] References Cited

U.S. PATENT DOCUMENTS

| | | | |
|---|---|---|---|
| 3,926,519 | 12/1975 | Rebres | 355/208 |
| 4,078,787 | 3/1978 | Burlew et al. | 355/323 X |
| 4,511,243 | 4/1985 | Smith | 355/209 |
| 4,627,706 | 12/1986 | Takahashi et al. | 355/311 |
| 4,648,709 | 3/1987 | Bushaw | 355/311 X |
| 4,685,797 | 8/1987 | Ito | 355/313 |
| 4,757,356 | 7/1988 | Garofalo | 355/323 |

FOREIGN PATENT DOCUMENTS 3516275 11/1985 Fed. Rep. of Germany .

*Primary Examiner*—Fred L. Braun

*Attorney, Agent, or Firm*—Beveridge, DeGrandi & Weilacher

[57] ABSTRACT

An image forming apparatus which facilitates the input and output of copy paper. One embodiment includes an image forming apparatus with paper supply trays, a development area, a console and a sorter. By pressing a transparent paper mode key on the console, normal and projector paper are sequentially fed from the trays to the development area and then to the sorter. The sorter is set in one of three modes by a sorter instructor. A manual key on the console allows an operator to set the instructor to position the sorter in any one of the three modes. The pressing of the transparent paper mode key or the detection by a detector of transparent paper in the feeding tray results in the instructor setting the sorter in a non-sort mode despite the sort instructor having been previously set in a different mode. Also, another embodiment of the invention includes a judging device for judging whether a cover copy mode or a page numbering mode has been inputted to the copying assembly and, if so, then the sorter instructor sets the sorter in a sort mode. Another embodiment uses a selecting device to match the detected size and orientation of the transparent paper with a similar detected size in one of a plurality of cassettes containing non-transparent paper. An additional embodiment features rear and face discharging modes which, when set, result in a predetermined positioning and sequencing of the transparent projector and normal paper.

7 Claims, 27 Drawing Sheets

(a)

(b)

(a)

(a)

(b)

(a)

(b)

IMAGE FORMING APPARATUS HAVING MEANS FOR COORDINATING THE INPUT AND DISCHARGE OF COPY PAPER

BACKGROUND OF THE INVENTION

1. Field of the Invention

The present invention is related to an image forming apparatus such as a copying machine provided with a sorter for utilizing an OHP (Overhead Projector) paper.

2. Description of the Related Art (1) In an OHP copy mode of an image forming apparatus, for example, in a copying machine utilizing a transparent paper such as OHP paper, the OHP paper is beforehand set in a paper cassette and a manuscript is copied with the OHP paper being supplied.

Then when two or more copies of the manuscript are executed, a sort function is frequently used.

In a conventional copying machine, when the OHP copy mode is set, and the sorting mode is set, the copied OHP paper is discharged on a sort bin through an inner passage of the sorter.

Because the OHP paper is comparably thick and lacks flexibility, and since the inner passage of the sorter has a sharply bending part, the passage is often clogged with paper (paper jam).

(2) Another conventional copying machine has a sorter and can also execute various kinds of copy functions, such as cover copy mode, and page writing mode.

In such conventional copying machine, when the operator copies using the sort mode, the operator instructs the sort mode to the primary part of the copying machine and the sorter by pushing a sort mode key on a console. On the other hand, in another conventional copying machine, for avoiding such troublesome operation, when two or more copies of the manuscript are set by a set key, the sort mode controlling is automatically instructed to the primary part of the copying machine and the sorter without the above-mentioned operator's pushing operation.

However in the latter-mentioned copying machine, as above-mentioned, when two or more copies of the manuscript are set by the set key, the sort mode controlling is automatically instructed to the primary part of the copying machine and the sorter. Therefore when the operator wishes to use a group mode, the operator should newly set the group mode. And when the operator forgets the setting of the group mode, the group mode is not executed and the order of the copied papers becomes contradictory to the operator's will.

(3) Another conventional copying machine is known wherein OHP paper and normal paper are alternately supplied to the primary part of the copying machine, and the normal paper and the OHP paper are discharged with the normal paper being between the copied OHP papers.

Such a conventional copying machine is disclosed, for example, in Japanese Laid-Open Patent Publication No. sho 62-59971.

The conventional copying machine comprises plural trays, an OHP paper supplying means for supplying the OHP paper one by one from a tray having the OHP papers therein, a normal paper supplying means for supplying the normal paper one by one from a tray having the normal papers therein, an image forming stopping means for temporarily stopping the image forming, an OHP mode selecting means for setting a mode of forming a copy image on the OHP paper, and a controlling means for controlling the OHP paper supplying means, the normal paper supplying means and the image forming stopping means, and thereby to alternately discharge the copied OHP paper and the normal paper under an OHP mode.

Since the conventional OHP paper copying machine discharges the normal paper and the OHP paper with the normal paper being between the OHP papers, operation and maintenance of the OHP paper is convenient. Then it is preferable that the size of the OHP paper is the same as that of the normal paper and the discharged direction of the OHP paper is the same as that of the normal paper.

However, the above-mentioned OHP paper copying machine lacks such function for making the size and discharged direction of the OHP paper the same as those of the normal paper. Therefore the OHP paper of A4 size and the normal paper of B4 size happen to be alternately discharged. Further, even when the size is the same, on account of the different discharged direction, the operator has to arrange the direction of the discharged OHP paper and the normal paper afterwards.

(4) Recently over-head projectors have often been used in a lectures. An OHP paper as a manuscript is utilized in the over-head projector.

Such an image forming apparatus is known in, for example, Japanese Laid-Open Patent Publication No. sho 62-141576 wherein the OHP paper and a ground sheet are discharged over one another to the same tray, so that the content of the OHP paper is easily read. That is, the OHP paper and the normal paper as the ground paper are alternately supplied and discharged one by one with the OHP paper being at the top. Thus the copied OHP paper and the non-copied normal paper overlap each other in the discharge tray, or the copied OHP paper and the copied normal paper overlap each other in the discharge tray.

On the other hand, the conventional copying machine has a face discharge mode in which the copied paper is discharged with the copied surface upward, and a rear discharge mode in which the copied paper is discharged with the copied surface downward. When the face discharge mode is used, the normal paper serving as the ground paper is laid on the copied surface of the OHP paper discharged in advance, and thus there is the trouble that the normal paper cannot serve as the ground paper.

When the image on the OHP paper is also copied to the normal paper, the trouble is particularly conspicuous.

SUMMARY OF THE INVENTION (1) The present invention intends to offer such image forming apparatus that when an OHP paper is used, the use of the sorter is forbidden.

An image forming apparatus of the present invention comprises:

mode instructing means for instructing sort mode and so on, paper supplying means for supplying paper, and non-sort mode instructing means for producing a signal to set the image forming apparatus at a non-sort mode on the basis of a transparent paper switch which produces a signal with regard to a transparent paper.

(2) The present invention intends to offer such image forming apparatus such that the necessity of a sort mode use is not judged by the number of copies of a manuscript but judged by the content of an operator's instructing mode, and thereby the image forming apparatus is set to a sort mode.

An image forming apparatus of the present invention comprises;

mode instructing means for instructing various kinds of copy modes such as a both sided copy mode, a cover copy mode, a sorter for sorting a copied paper, judging means for judging whether the instructed mode from the mode instructing means is such mode that necessitates a sort mode of the sorter or not, and sort instructing means for making control of the sorter at sort mode on the basis of the judging of the judging means.

(3) The present invention intends to offer such image forming apparatus that the above-mentioned operator's arrangement of the OHP paper and the normal paper after the copying is omitted.

An image forming apparatus of the present invention comprises;

paper size detecting means for detecting size and direction of an OHP paper supplied from an instructed first paper supplying means, paper supplying means selection means for selecting a second paper supplying means in which a paper cassette is set, the paper cassette having a paper of the same size and same direction as the size and direction detected by the paper size detecting means, and copying means for copying at least the OHP paper, by alternately supplying the OHP paper and the paper from the first paper supplying means and the second paper supplying means.

(4) The present invention intends to offer such image forming apparatus that a paper serves as a ground paper irrespective of the face and rear discharge modes of the OHP paper.

An image forming apparatus of the present invention comprises;

printing means for printing image on a supplied paper,

OHP paper(film) supplying means for supplying an OHP paper to the printing means, ground paper supplying means for supplying an ground paper to the printing means, face discharging means for discharging and stacking papers printed by the printing means with the printed surface upwards, rear discharging means for discharging and stacking papers printed by the printing means with the printed surface downwards, discharging mode selecting means for selecting the mode among the face discharging mode and the rear discharging mode, face discharging mode control means for controlling the OHP paper supplying means, the ground paper supplying means and the face discharging means in a manner that first the ground paper is discharged and, next, the OHP paper is discharged to the printing means when the face discharging mode is selected by the discharging mode selecting means, and rear discharging mode control means for controlling the OHP paper supplying means, the ground paper supplying means and the rear discharging means, in a manner that first the OHP paper is discharged and next the ground paper is discharged to the printing means when the rear discharging mode is selected by the discharging mode selecting means.

Other and further objects, features and advantages of the invention will appear more fully from the following description.

DESCRIPTION OF PREFERRED EMBODIMENTS

Figure 1:
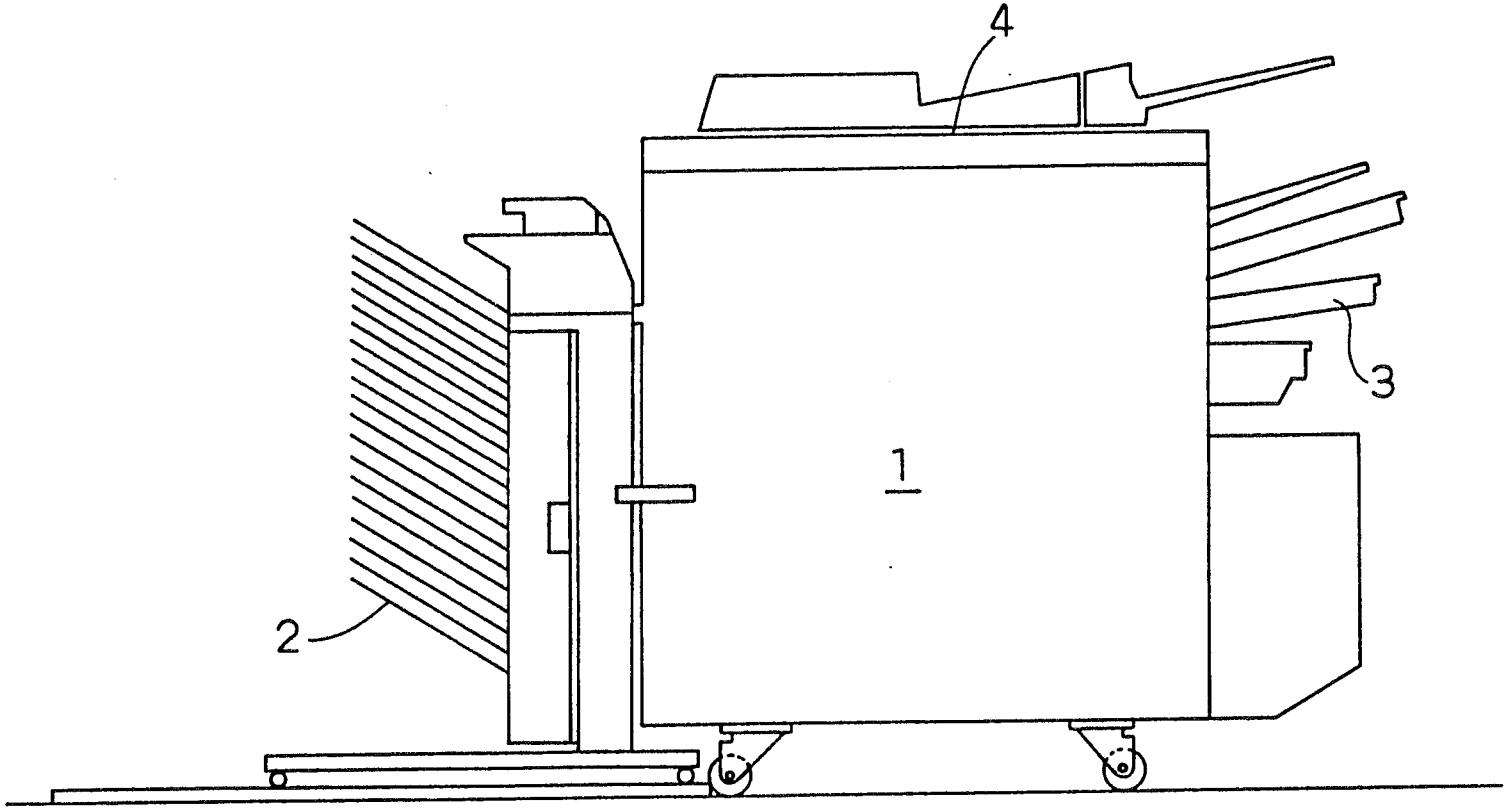
FIG. 1 is a front view showing an embodiment of an image forming apparatus of the present invention.

FIG. 1 is a front view showing a copying machine as an embodiment of an image forming apparatus of the present invention.

Figure 2:
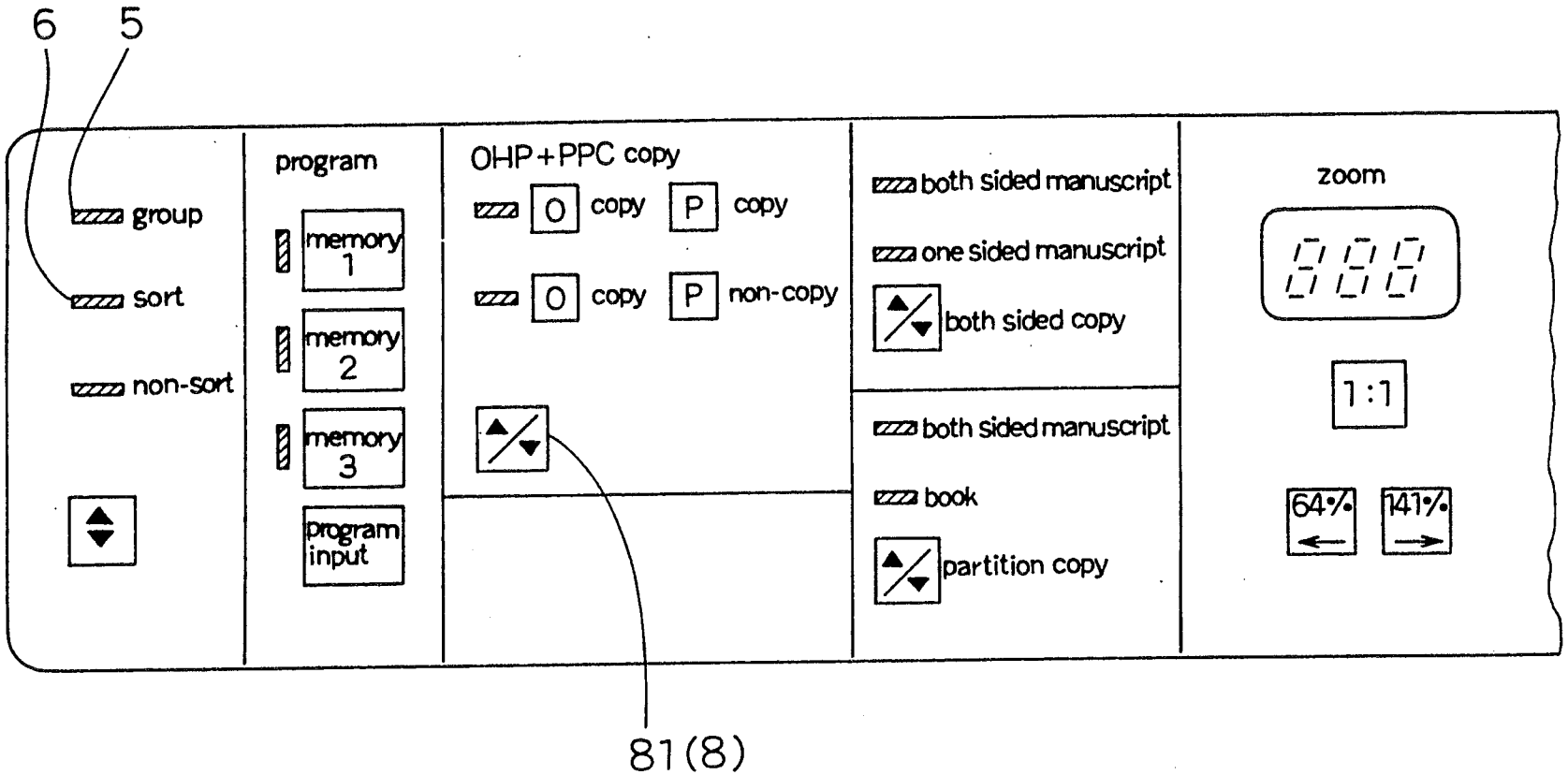
FIGS. 2(*a*), 2(*b*) are plane views showing a console of the embodiment of the present invention.
Figure 2:
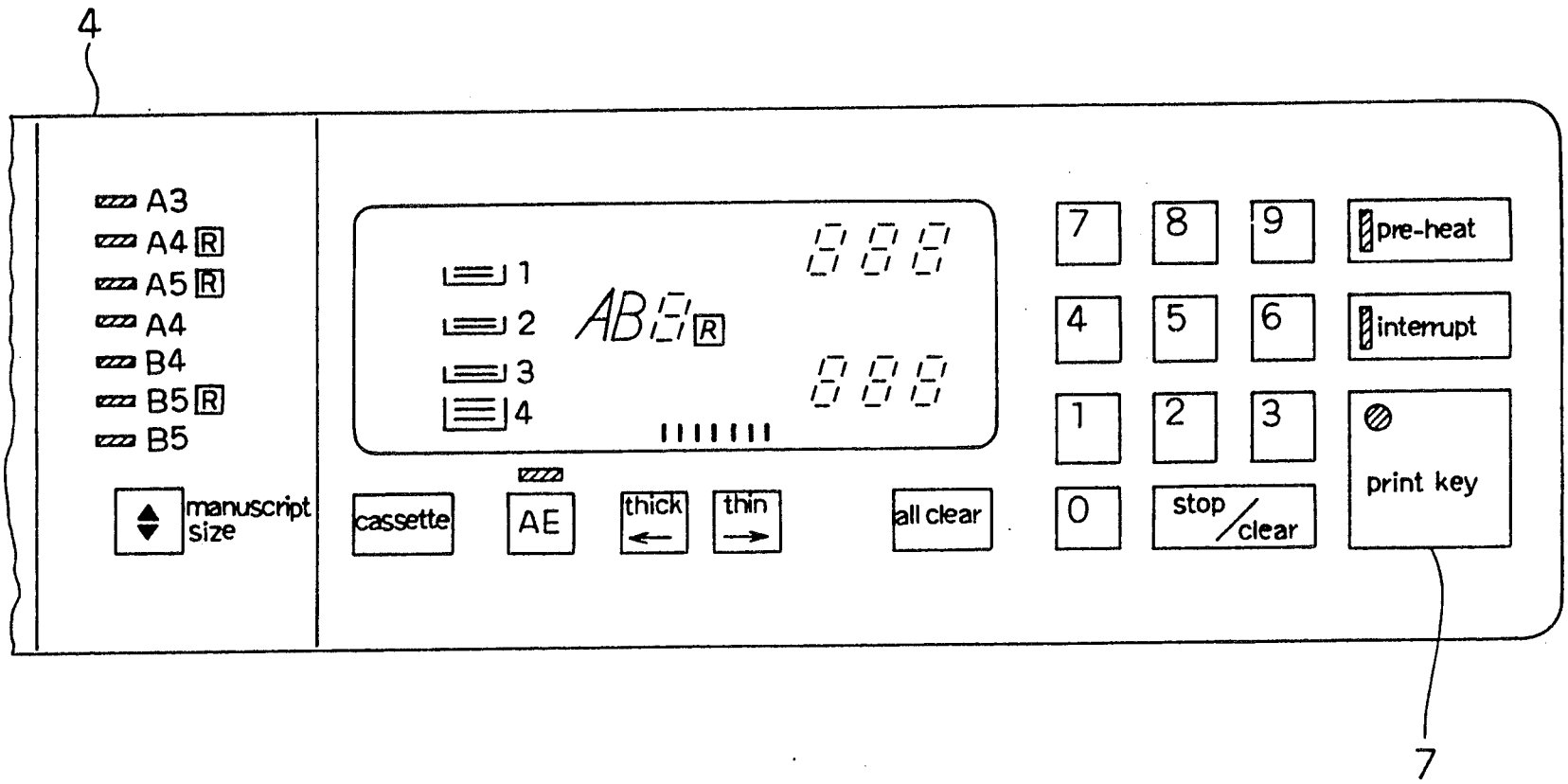

In FIG. 1, a sorter 2 is installed to a left side of a primary part of the copying machine 1. A paper supplying means 3 is installed to a right side of the primary part of the copying machine 1. A console 4 as, shown in FIG. 2, is installed to an upside of the primary part of the copying machine 1. A group mode key (stack mode key) 5, a sort mode key 6 and a print key 7 for starting the copying operation and so on are attached to the console 4. As shown in FIG. 2, below the sort mode key 6 is a non-sort key and below the non-sort key is a manual up/down selection button. As is conventional in the art, manipulation of the selection button results in signaling of a sorter instructor to move the sorter into one of the three modes.

The image forming apparatus of the present invention has a transparent paper switch 8 for outputting signals with regard to transparent paper. The transparent paper means a paper of an OHP(over-head projector) paper and so on.

For example, the transparent paper switch 8 is a transparent paper image forming mode instructing means 81 formed on the console 4. In FIGS. 2(*a*), (*b*), a known OHP copy mode instruction means serves as the transparent paper image forming mode instructing means 81. Or, the transparent paper switch 8 is a transparent paper detecting means 82 mounted to the paper supplying means 3 as shown in FIG. 4 and FIG. 5.

Figure 4:
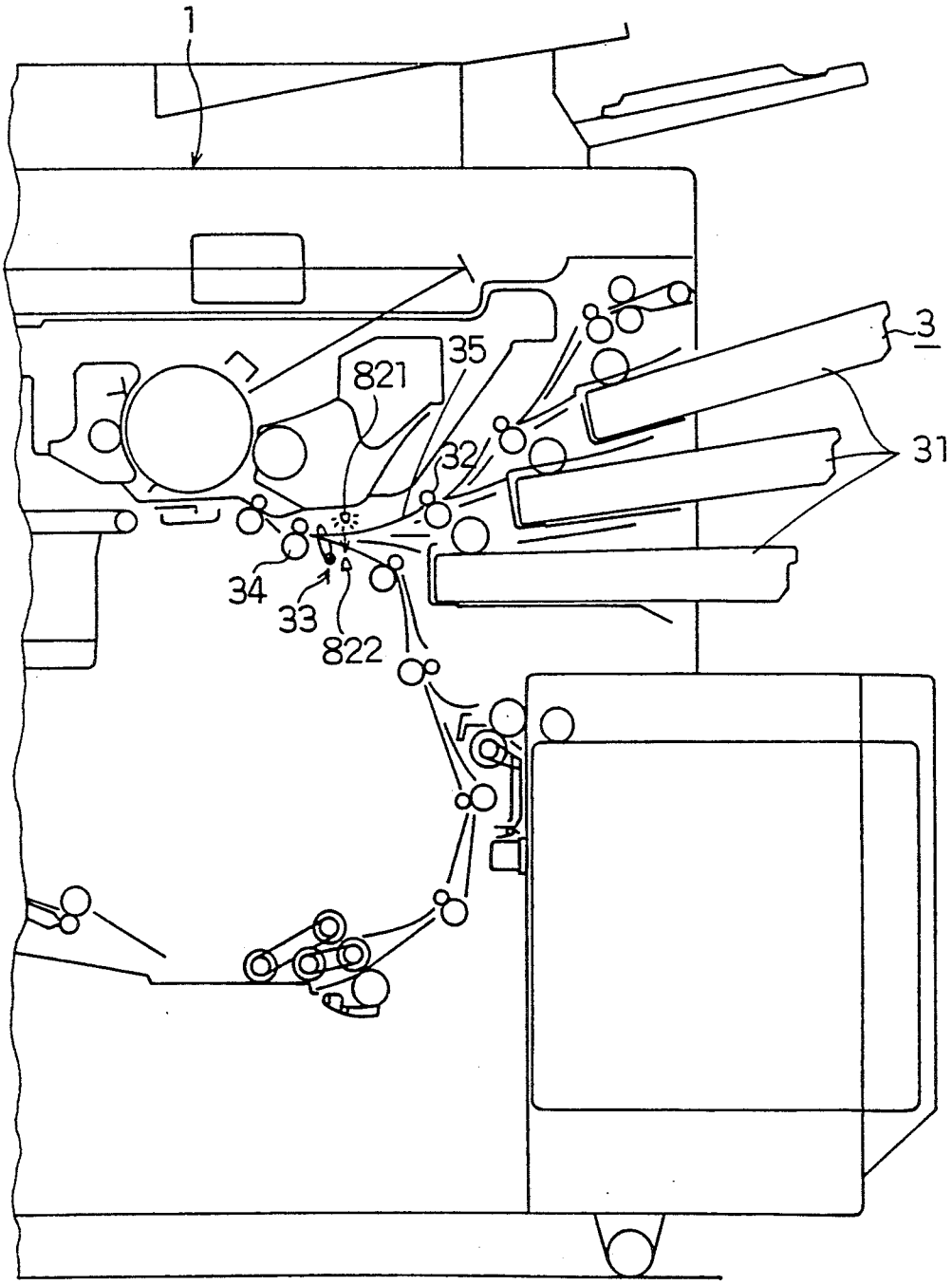
FIG. 4 is a longitudinal section view showing a mechanism of the embodiment of the present invention.

In FIG. 4, 31 indicates a paper cassette of the paper supplying means 3, and 32 indicates a paper roller for supplying the paper 35 in the paper cassette 31. 33 indicates a resist front switch, and 34 indicates a resist roller. The transparent paper detecting means 82 is set in front of the resist front switch 33. The transparent paper detecting means 82 comprises a device 821 for emitting light installed above a passage route of the paper 35, and a device 822 for receiving light installed at a corresponding position(to the device 821) under the passage route. The device 821 emits light and the device 822 receives the light. When the carried paper 35 is a transparent paper, the light passes through the paper 35, and the device 822 receives the light, thereby to output the receiving signal.

Figure 5:
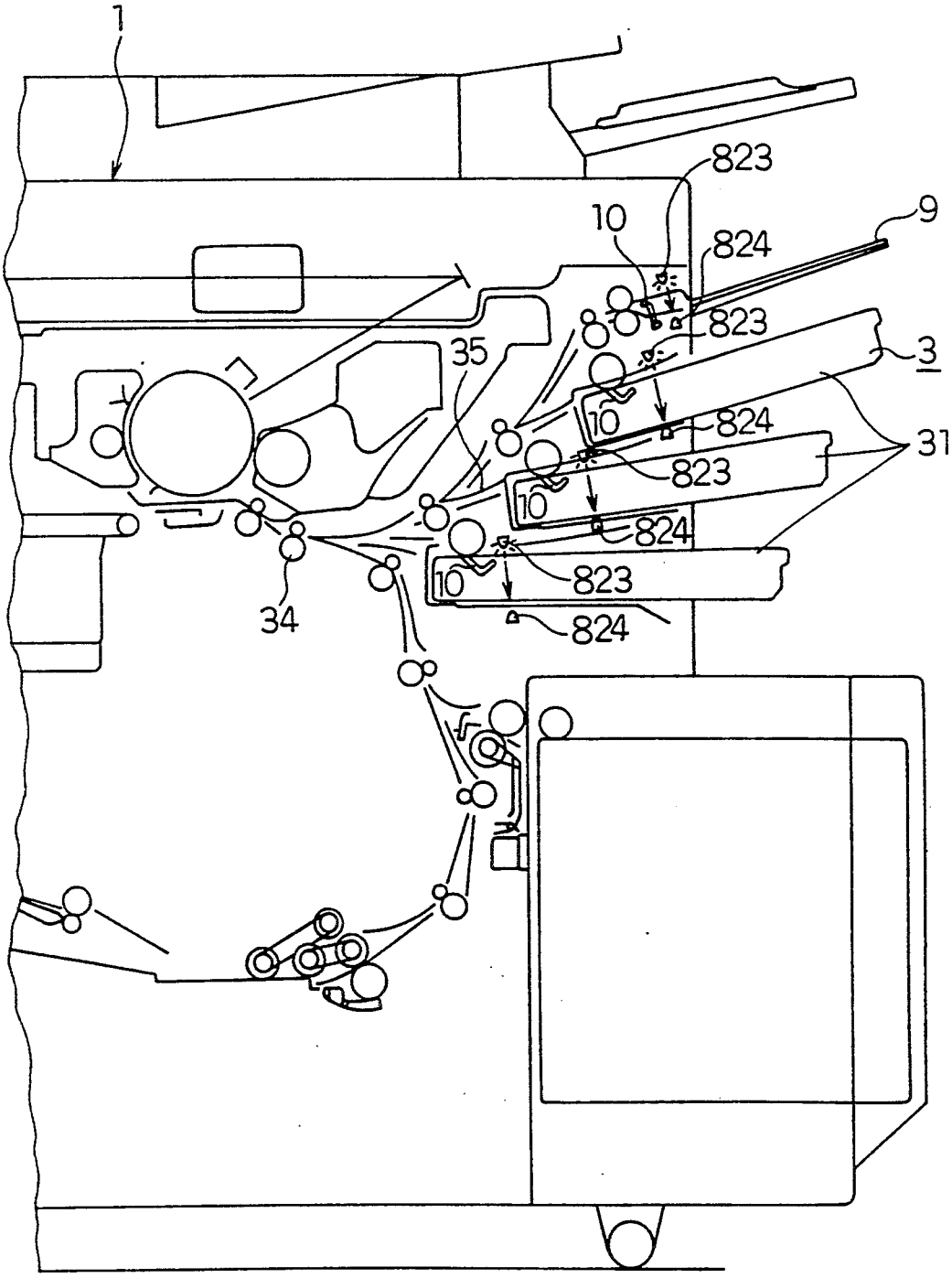
FIG. 5 is a longitudinal section view showing a mechanism of another embodiment of the present invention.

Then in FIG. 5, the transparent paper detecting means 82 comprises a device 823 for emitting light installed above the set paper cassette 31, and a device 824 for receiving light installed at a corresponding position(to the device 823) under the paper cassette 31. The device 823 and the device 824 have the same function as the device 821 and the device 822. With regard to a manual set tray 9, the device 823 for emitting light and the device 824 for receiving light are installed above and under the manual set tray 9. In FIG. 5, 10 indicates a paper detecting switch for the paper 35 in the paper cassette 31 and the manual set tray 9.

Figure 3:
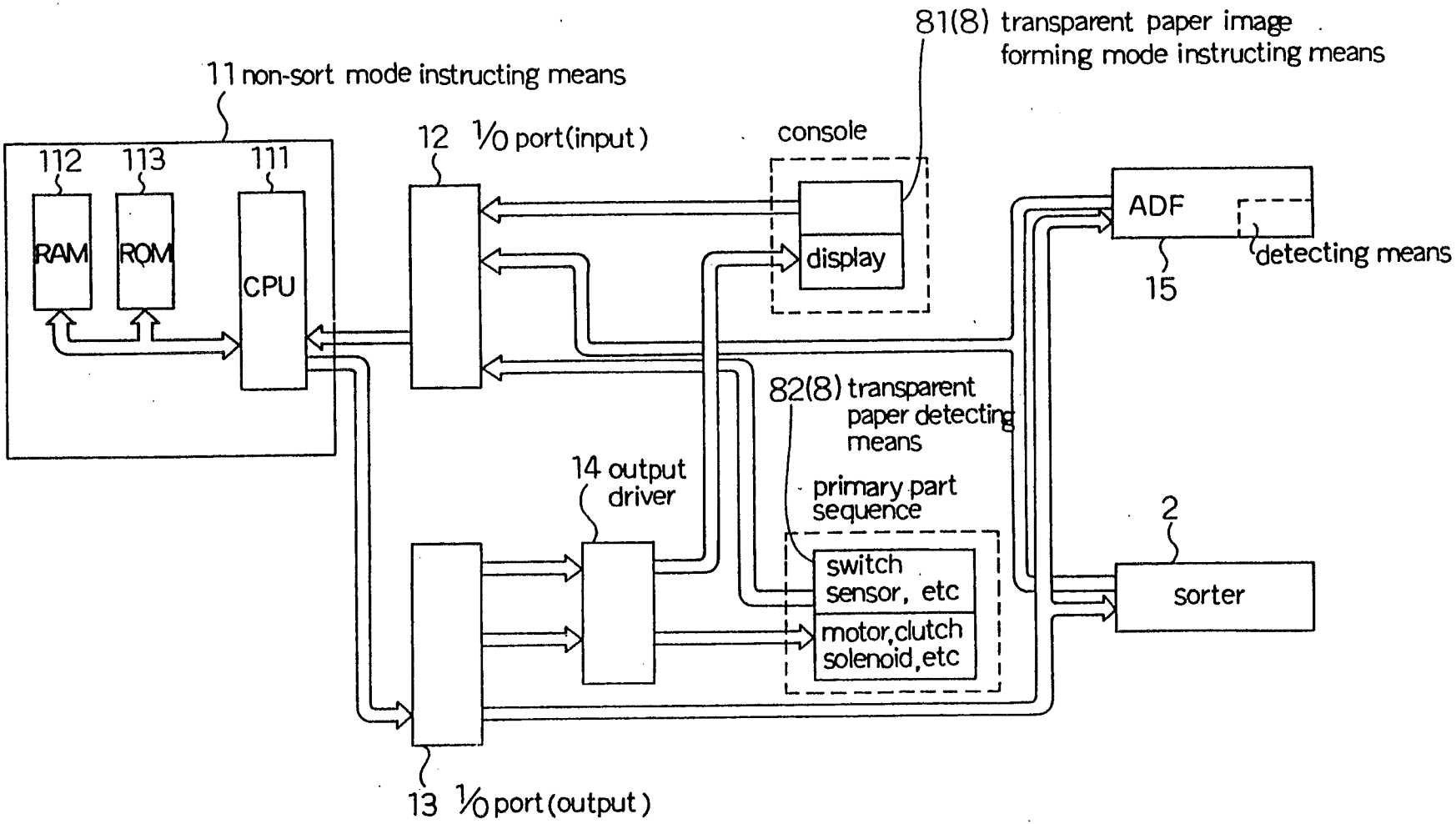
FIG. 3 is a block diagram showing one embodiment, mainly as to signals.

FIG. 3 is a block diagram showing the embodiment, mainly as it pertains to signals.

As shown in FIG. 3, a non-sort mode instructing means 11 receives signals from the transparent paper switch 8 of the transparent paper image forming mode instructing means 81 or the transparent paper detecting means 82 etc., and outputs a signal for setting the image forming apparatus at a non-sort mode. The non-sort mode means, in the embodiment, not-executing sort mode and besides not-executing group sort(stack mode), that is, under the non-sort mode the normal discharging of paper is executed. The non-sort mode instructing means 11 comprises, for example, a central processing unit(CPU) 111, RAM memory 112, ROM memory 113 etc. In FIG. 3, 12 indicates an I/O port for supplying signals from the transparent paper image forming mode instructing means 81 to the non-sort mode instructing means 11. 13 indicates an I/O port for outputting signals from the non-sort mode instructing means 11. 14 indicates an output driver 14 for supplying the signals from the I/O port 13 to a displaying part of the console 4. 15 indicates an ADF (automatic document feeder).

Figure 6:
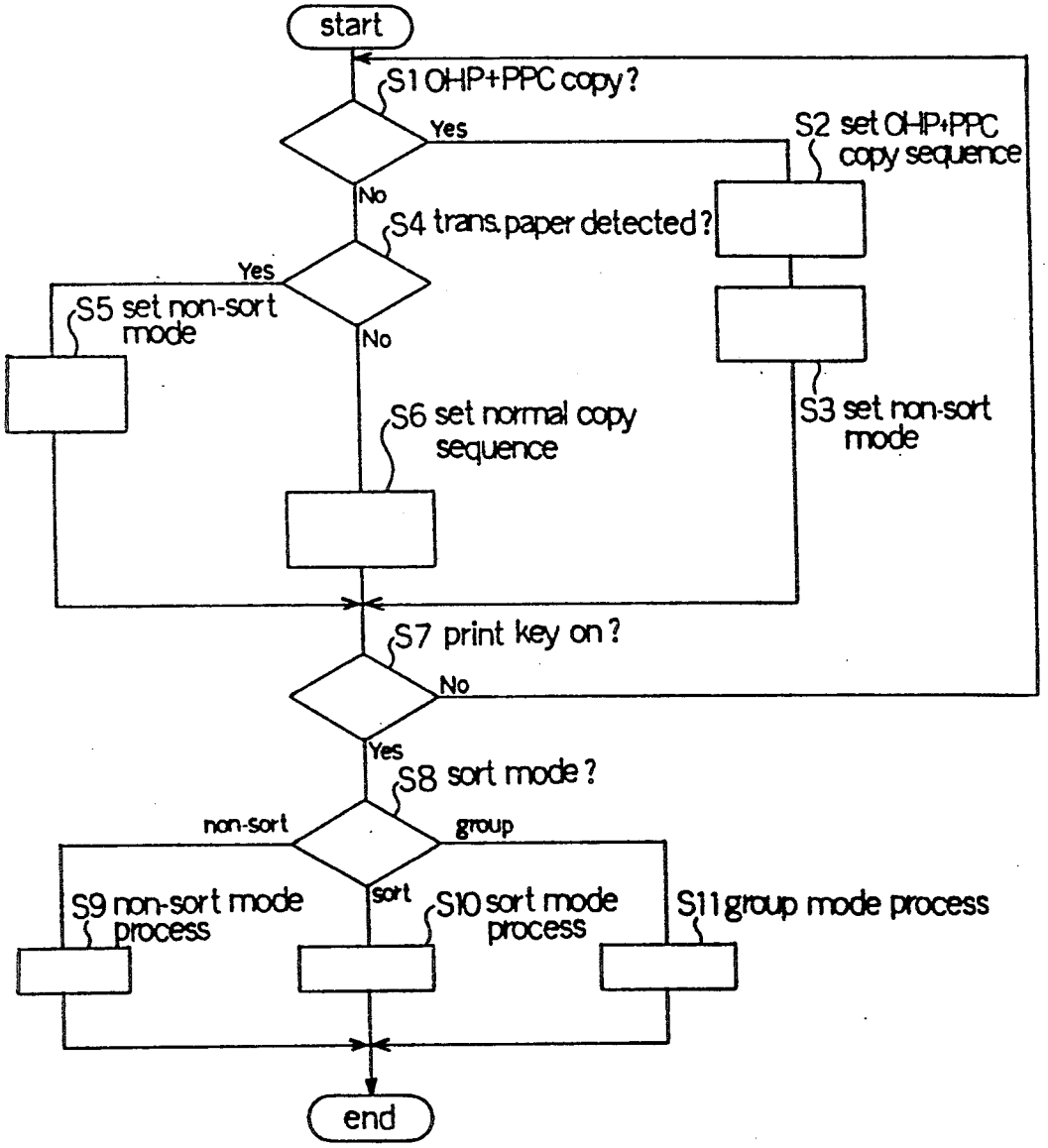
FIG. 6 is a flowchart showing the operation of one embodiment of the present invention.

Hereinafter, the operation of the above-mentioned embodiment is described on the basis of the flowchart of FIG. 6.

The operator copies a manuscript by pushing the OHP copy mode key of the transparent paper image forming instructing means 81 and by setting the OHP paper 35 in the paper cassette 31.

Non-sort mode instructing means 11 detects the signal from the transparent paper switch 8 of the transparent paper image forming mode instructing means 81 or the transparent paper detecting means 82. When a signal is applied from the transparent paper image forming mode instructing means 81(step s1), OHP+PPC copy sequence is set(step s2). The OHP+PPC copy sequence means that after one piece of the OHP paper is discharged with rear-copied state, a normal paper is discharged as a ground sheet on the OHP paper. Thus one pair of one piece of the OHP paper and one piece of the normal paper is produced. And the non-sort mode is set for suppressing the driving of the sorter 2 (step s3).

When signals are not applied from the transparent paper image forming apparatus 81 (step s1), a signal from the transparent paper detecting means 82 is examined. When the signal is applied(step s4), the non-sort mode is set for suppressing the driving of the sorter 2 (step s5).

When the signals from the transparent paper image forming mode instructing means 81 and the transparent paper detecting means 82 are not found (step s1, s4), a normal copy sequence for executing normal copying is set (step s6).

Then when the print key 7 is pushed (step s7), the primary part of the copying machine 1 judges what is the mode to be executed. In case of the sort mode, sort process is executed (s10) and in case of the group mode, group process is executed (s11). And in case of the non-sort mode, normal mode process is executed (step s9).

Figure 7:
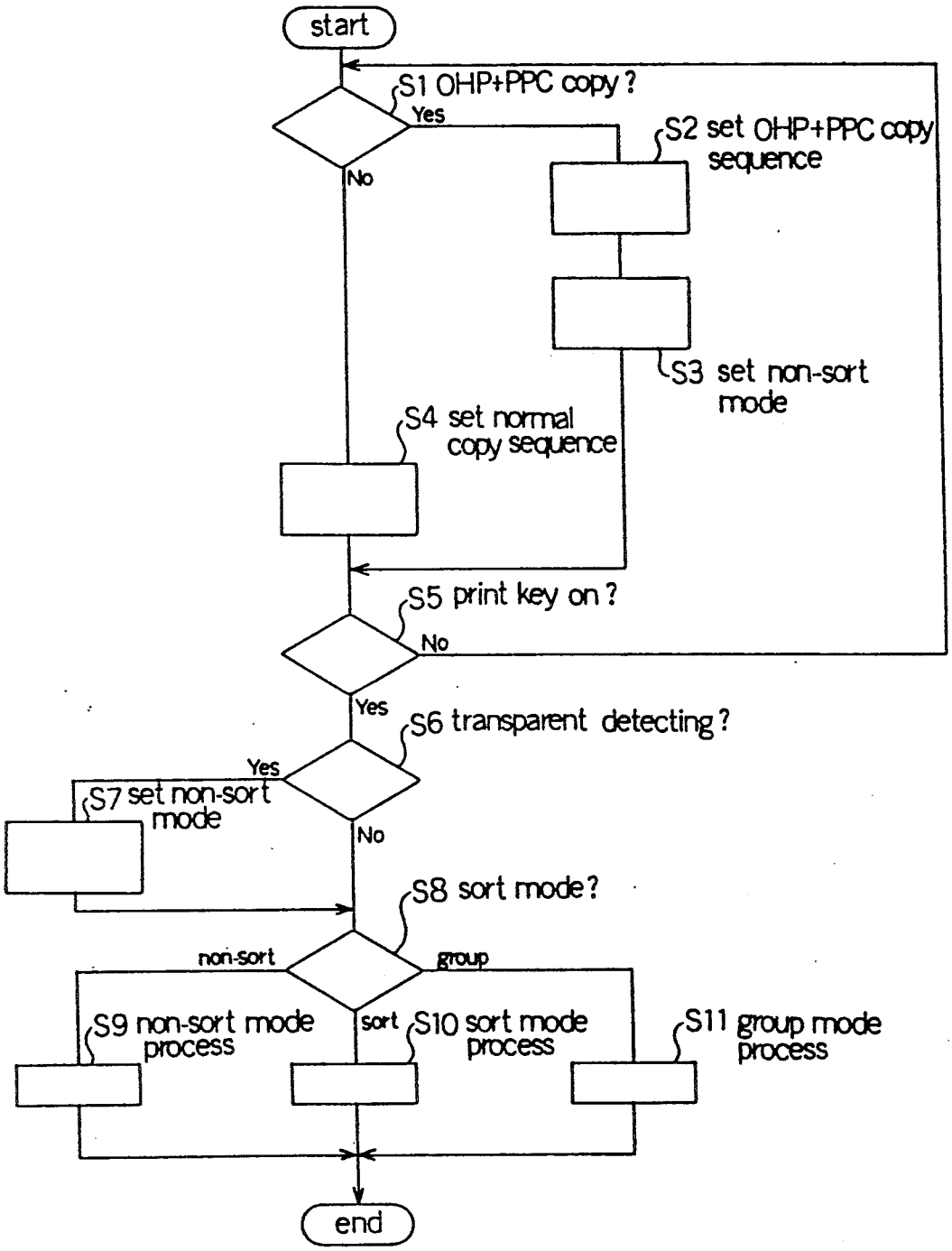
FIG. 7 is another flowchart showing operation of one embodiment of the present invention.

FIG. 7 shows the operation when the transparent paper detecting means 82 is set in front of the resist-front switch 33. In that case, the judging of the detection of the transparent paper is executed after the judging of the operation of the print key 7. This other operation is similar to the embodiment of FIG. 6.

Meanwhile the present invention enforcively makes the copying machine at non-sort mode even when the copying machine was set at sort mode.

As mentioned above, the image forming apparatus of the present invention comprises the non-sort mode instructing means for receiving signals from the transparent paper switch and outputting signals of setting the image forming apparatus at non-sort mode. Therefore, when the transparent paper of the OHP paper etc. is used, there is no possibility of the driving of the sorter. As a result, the transparent paper does not pass through the passage route having the sharp curve of the sorter, and therefore a paper jam does not occur.

Under the OHP copy mode, the copied OHP paper and the normal paper as the ground paper do not separately discharge to the bins of the sorter.

Hereinafter an embodiment of an image forming apparatus of another present invention is disclosed.

Figure 8:
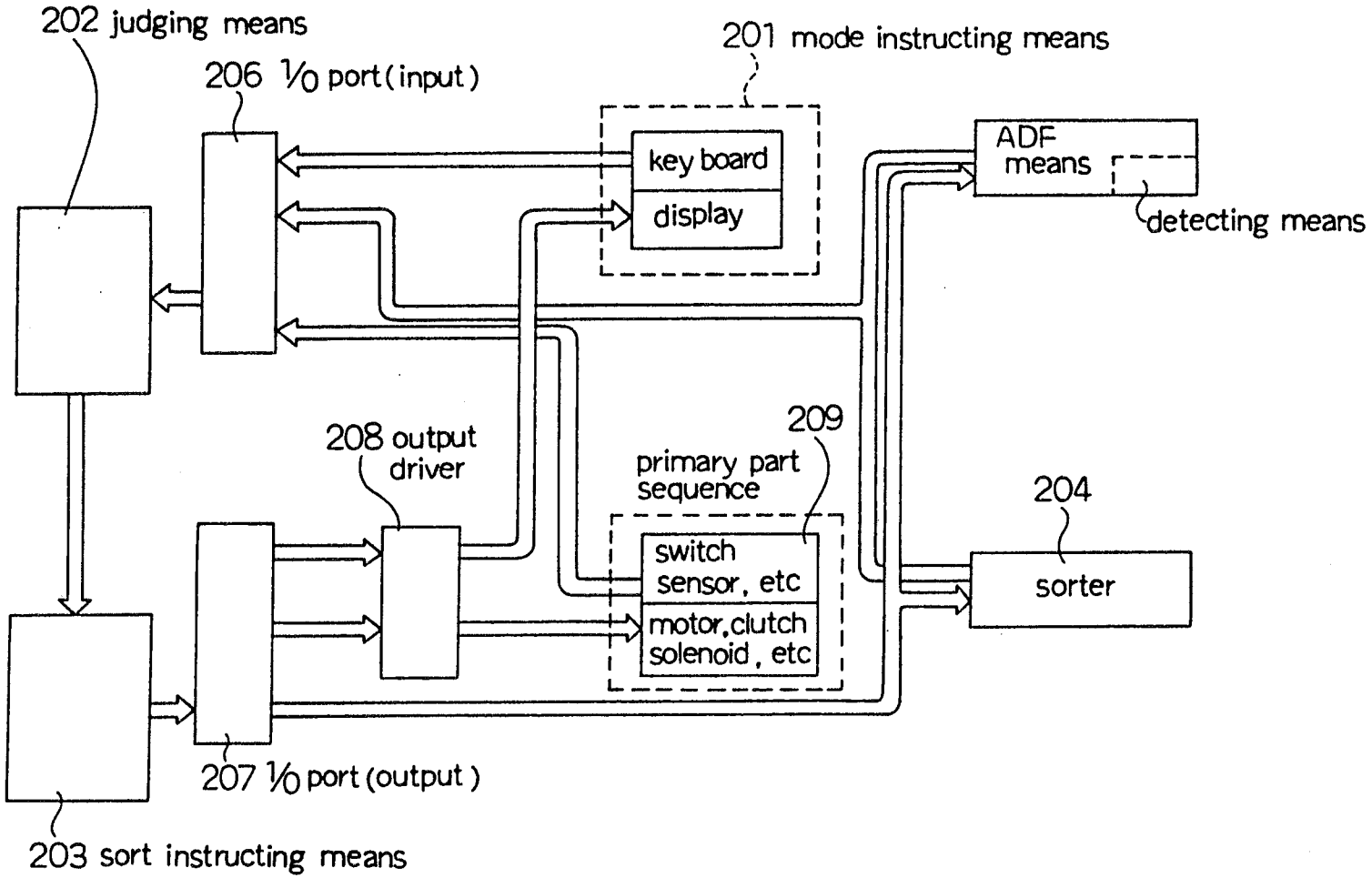
FIG. 8 is a block diagram showing another embodiment of an image forming apparatus of the present invention.

FIG. 8 is a block diagram showing the embodiment of the present invention.

Figure 9:
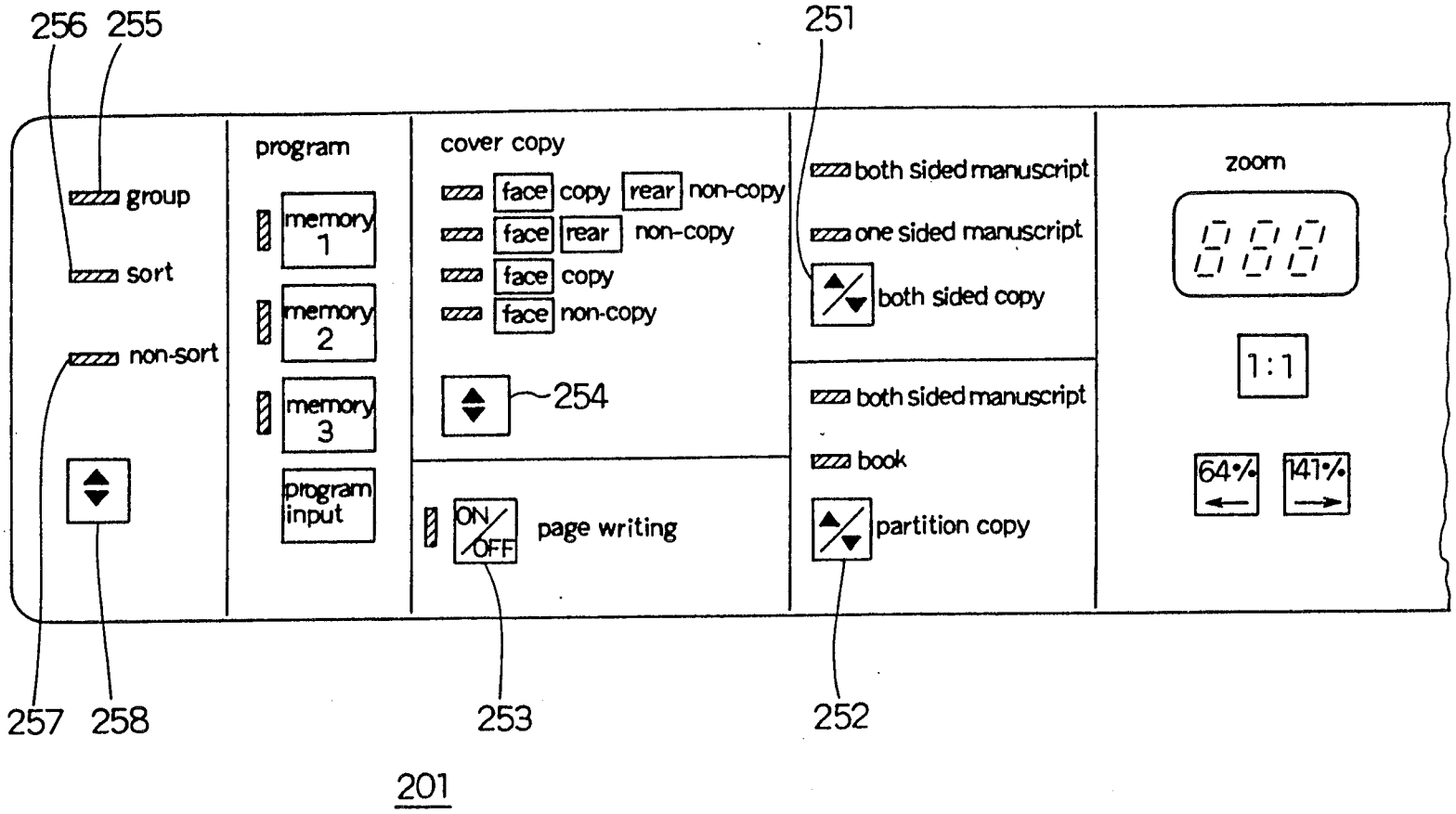
FIGS. 9(*a*), 9(*b*) are plane views showing a console of an embodiment of the present invention.
Figure 9:
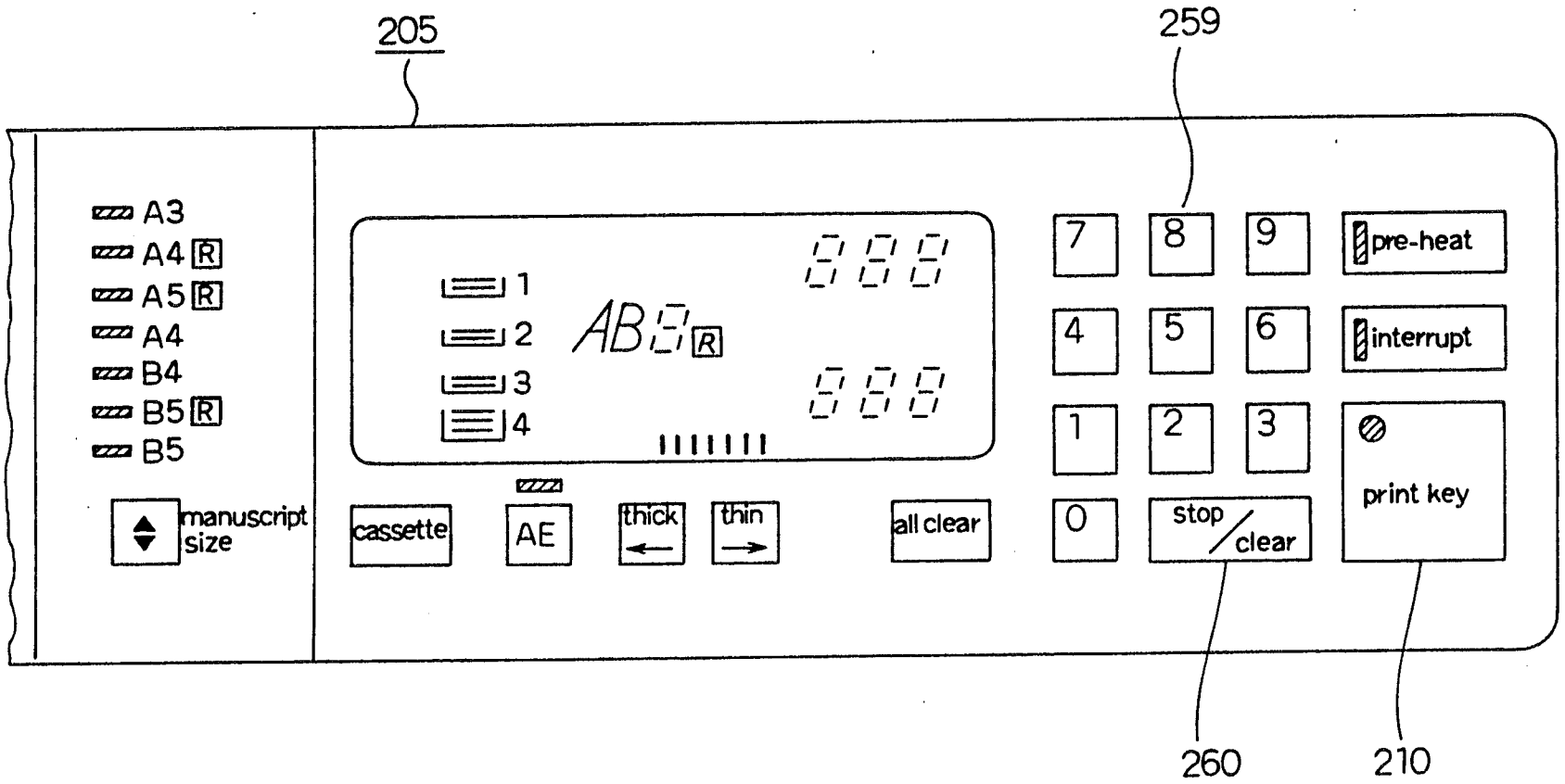

A mode instructing means 201 in FIG. 8 is such means for instructing a both sided copy mode, a cover copy mode and so on. The mode instructing means 201 is, for example, set on a console 205 installed to the upward and front side of the primary part of the image forming apparatus as shown in FIGS. 9(*a*), (*b*). In FIG. 9, 251 indicates a both sided copy key for instructing a both sided copy mode, 252 indicates a partition copy key for instructing a partition copy mode, 253 indicates a page writing key for instructing a page writing mode, 254 indicates a cover copy key for instructing a cover copy mode, 258 indicates a mode exchange key for setting the control of the sorter to a group mode, a sort mode or a non-sort mode, 255 indicates a display part of the group mode, 256 indicates a display part of the sort mode and 257 indicates a display part of the non-sort mode.

Figure 10:
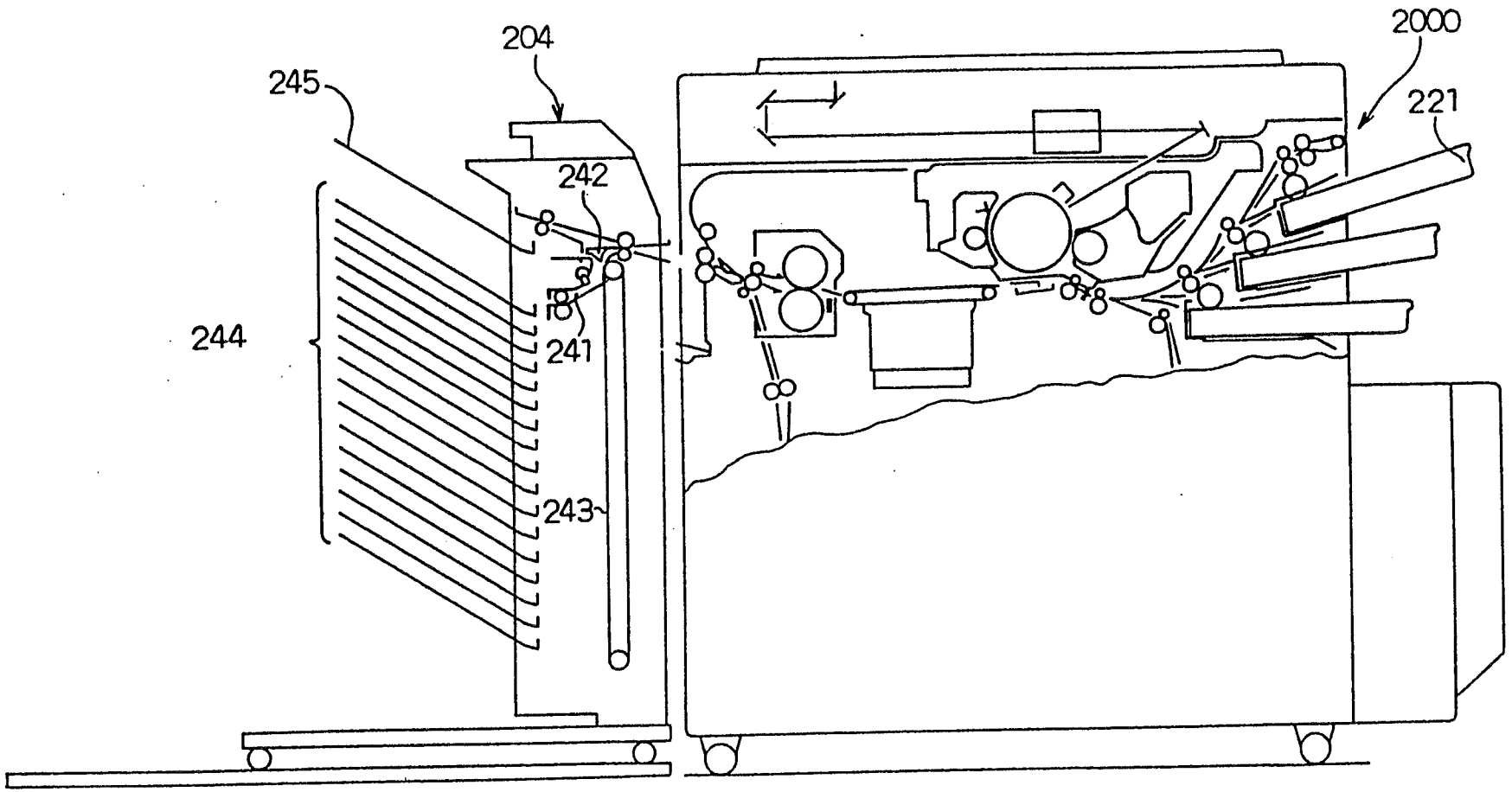
FIG. 10 is a schematic section view showing an embodiment of the present invention.

FIG. 10 is a schematic section view showing the embodiment having the sorter 204 of the image forming apparatus of the present invention.

The sorter 204 is installed to the side of the primary part 2000 of the image forming apparatus. The sorter 204 has a non-sort bin 245 on its uppermost position. Below non-sort mode, the copied papers are discharged to the non-sort bin 245. Under the non-sort bin 245, there are plural bins 244 to which the copied papers under the group mode or the sort mode are discharged. A carrying exchange pin 242 exchanges a pin, thereby to discharge the carried papers from the primary part of the image forming apparatus 2000 to the non-sort bin 245 or the bins 244. A movable discharge guide 241 moves up and down, thereby to discharge the papers carried downwards by the carrying exchange pin 242 to each bin 244 by utilizing a carrying belt 243. The movable discharge guide 241 moves from the uppermost bin 244 to the lowermost bin 244 and thereafter moves from the lowermost bin 244 to the uppermost bin 244 for subsequent copied papers.

Figure 11:
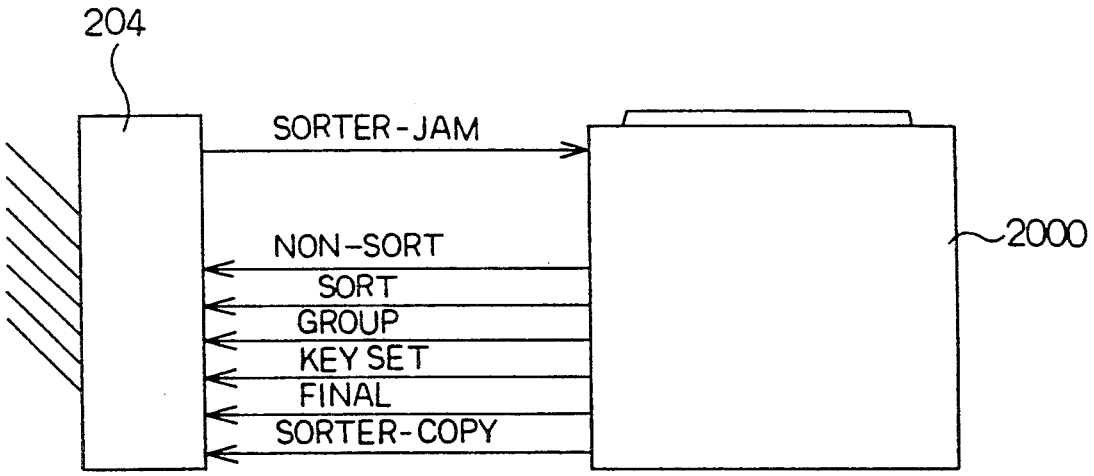
FIG. 11 is a signal view showing a giving and taking of the signals of one embodiment of the present invention.

FIG. 11 shows the taking and giving of the signals between the sorter 204 and the primary part 2000 of the image forming apparatus.

In FIG. 11 a SORTER-JAM signal is transmitted from the sorter 204 to the primary part 2000 of the image forming apparatus, and informs the occurrence of paper jam in the sorter 204 to the primary part 2000 of the image forming apparatus. When the sorter-jam signal is applied, the image forming apparatus stops the copying operation.

The below-mentioned signals are signals transmitted from the primary part 2000 to the sorter 204. The NON-SORT signal is a signal for instructing the non-sort mode control and the SORT signal is a signal for instructing the sort mode control and the GROUP signal is a signal for instructing the group mode control. A KEYSET signal is output when a ten key 259 or a clear key 260 on the console 205 of the primary part 2000 of the image forming apparatus is pushed, and under the sort mode, the KEYSET signal makes the movable discharge guide 241 transfer to the first bin (the uppermost bin 244) position. A FINAL signal is output when a copied counter number reaches a manually set copy number. The FINAL signal is also output when the copy operation is interrupted by the clear key 260. A SORTER-COPY signal is a signal indicating that the primary part 2000 of the image forming apparatus is copying and the SORTER-COPY signal is output from the timing of pushing the print key 210 until the completing timing of the copy operation.

Figure 17:
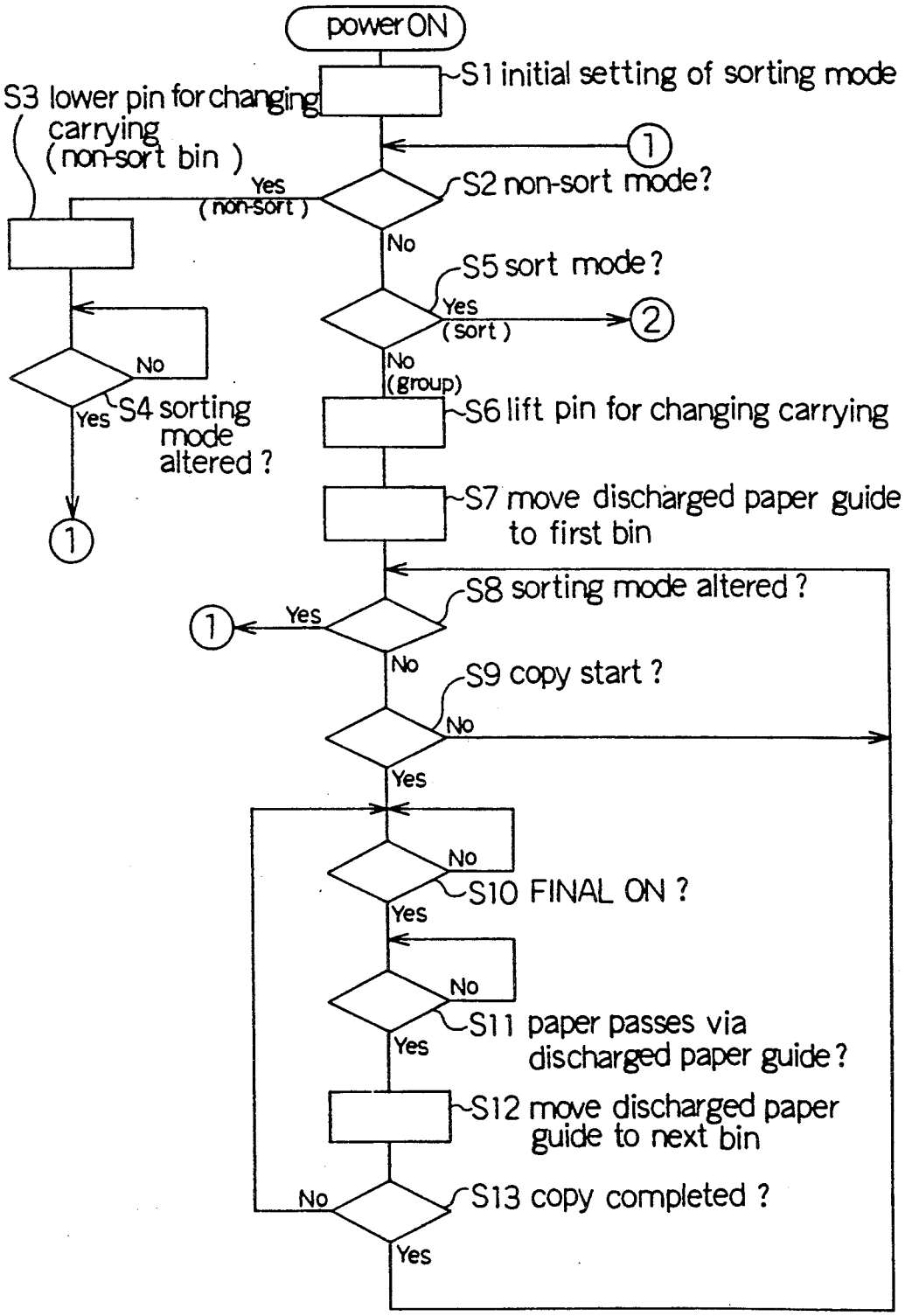
FIGS. 17(*a*), 17(*b*) are other flowcharts showing the operation of the present invention.
Figure 17:
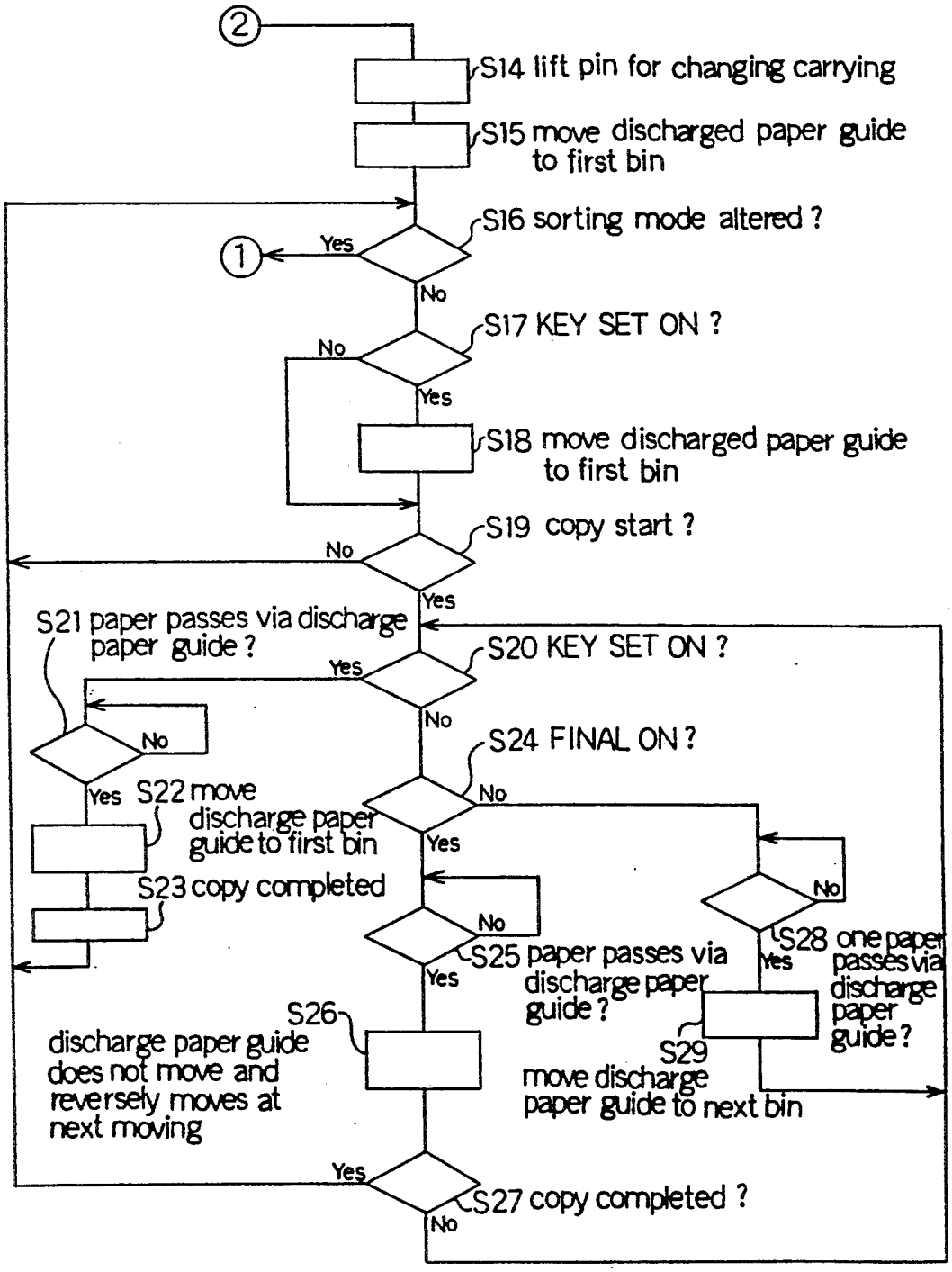

FIGS. 17(*a*), (*b*) are flowcharts showing in the detail copy operation of the embodiment, mainly with regard to the sorter 204. In FIG. 17 the sorting mode (sorter mode) means a generic mode including the sort mode, the non-sort mode and the group mode.

When the sorting mode is set (step s1) and besides the sorting mode is the non-sort mode (step s2), the carrying exchange pin 242 rotates downwards so as to make the passage route capable of discharging all copied papers to the non-sort bin 245(step s3). The carrying exchange pin 242 maintains its state(step s4).

On the contrary, when the sorting mode is the sort mode (step s5), the carrying exchange pin 242 rotates upwards, thereby to exchange the passage route(step s14), and the movable discharge guide 241 moves to the uppermost bin 244 (step s15). When the sorting mode is not changed(step s16), the KEYSET signal is examined, and if ON (step s17), the movable discharge guide 241 moves to the uppermost bin 244(step s18). When the movable discharge guide 241 exists at the uppermost bin 244, the movable discharge guide 241 stays there. When the copying is started (step s19), the KEYSET signal is examined(step s20), and the FINAL signal is examined (step s21). When there is not a FINAL signal, and one paper passes through the movable discharge guide 241 (step s28), the movable discharge guide 241 moves to one-step-under bin 244(step s29). When the FINAL signal is applied (step s24), and one paper passes through the movable discharge guide 241(step s25), the movable discharge guide 241 stays there and discharges a next paper to the bin 244 at the position. Hereinafter the movable discharge guide 241 discharges the papers as going up one by one. When the copying is completed, the movable discharge guide 241 waits till re-start(step s27, s19). When the KEYSET signal is applied (step s20), and one paper passes through the movable discharge guide 241 (step s21), the guide 241 moves to the uppermost bin 244(step s22) and the copying is completed (step s23).

On the contrary to the sorting mode is the group mode(step s5), the carrying exchange pin 242 moves upwards(step s6), and the movable guide 241 moves to the uppermost bin 244(step s7). When the copy mode is not changed (step s8), and the copy is started (step s9), the FINAL signal is examined(step s10). When one paper passes through the guide 241(step s11), the guide 241 moves to the next bin 244(step s12). After the copying, the guide 241 waits till re-start(step s13, s9).

A judging means 202 in FIG. 8, is means for receiving the output signal from the mode instructing means 201 via an I/O port 206 and for judging whether the instructed mode is the predetermined mode which makes the sorting control of the sorter the sort mode or not. The judging means 202, for example, judges whether a cover is to be attached to the copied papers or not, or whether page numbers are to be added to the copied papers or not, considering the order of the copied papers, in addition to the copying operation.

That is, the sort mode is substantially indispensable for the cover copy mode (the mode called as "face and rear copy mode") and the page writing copy mode. On the contrary the normal copy mode, the both sided copy mode, the partition copy mode (page successive copy mode) suitably use the non-sort mode, the sort mode or the group mode. Thus, a designer can select beforehand the kinds of modes necessitating the sort mode.

Figure 12:
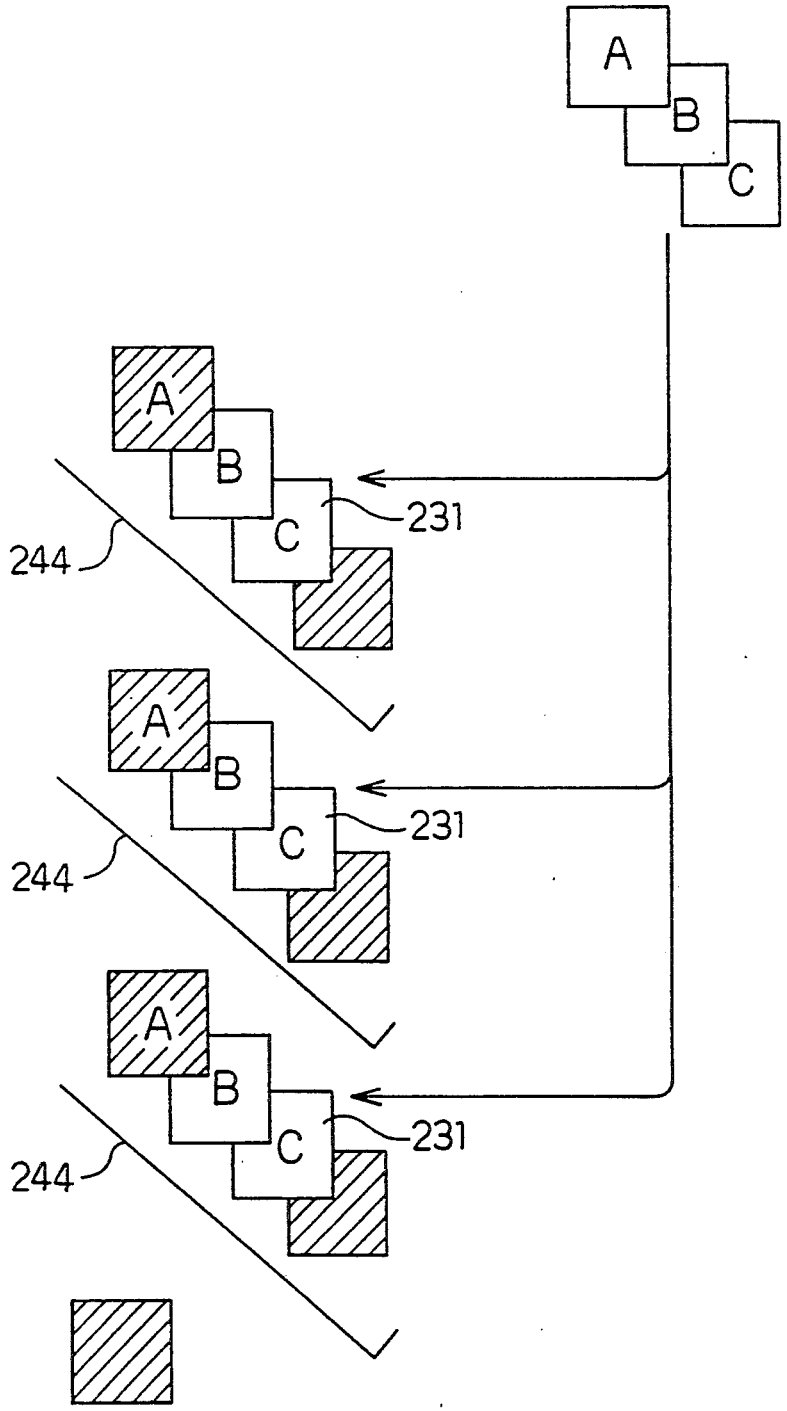
FIG. 12 is a plane view showing executed state of a cover copy mode of an embodiment of the present invention.
Figure 13:
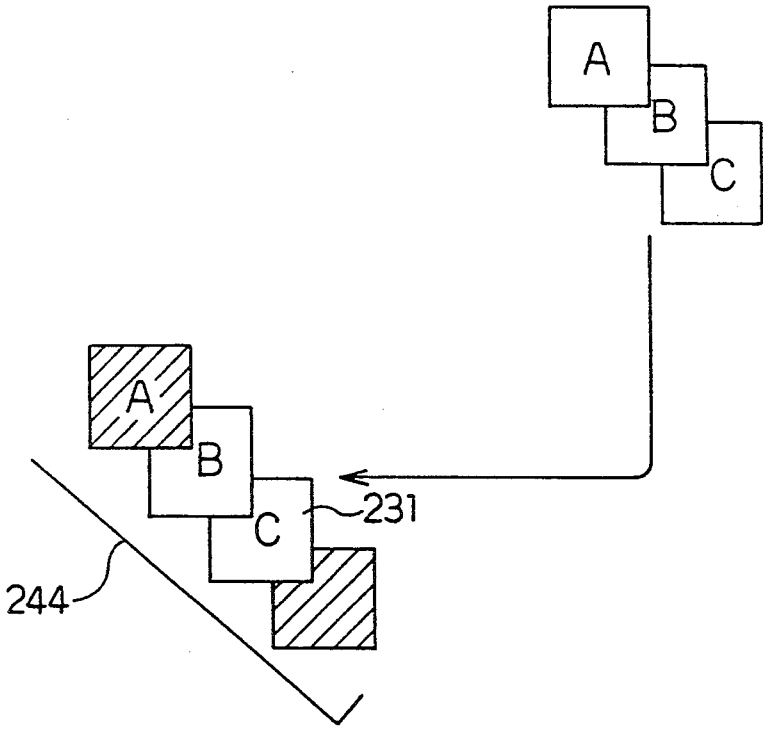
FIG. 13 is a plane view showing another executed state of the cover copy mode of the present invention.

The cover copy mode is such mode that, for example, when color pages are set in the uppermost cassette (a cassette 221 of FIG. 10), the color pages are automatically distributed to the face side and the rear side of the copied papers. The cover copy mode has the same 4 kinds of modes as the console 205 of FIG. 9. That is, the [face]copy-[rear]non-copy is, as shown in FIG. 12, such mode that a first manuscript is copied to the face color paper(hatched paper), and the rear color paper is not copied(recorded). The [face][rear]non-copy mode is such mode that the not-copied color paper is distributed to the face side and the rear side of the copied papers. The [face]copy mode is such mode that one color paper copied with the first manuscript is only added to the face side. The [face]non-copy mode is such mode that not-copied one color paper is only added to the face side. Thus if the sort mode is not executed under the cover copy mode, the cover is not suitably distributed. Therefore it is convenient that the sort mode is automatically set when the cover copy mode is selected. Meanwhile FIG. 13 shows the cover copy state when the pre-set piece number is 1. In this case, all copied papers and the cover paper are discharged to the uppermost bin 244 in FIG. 10 by the sort mode.

Figure 14:
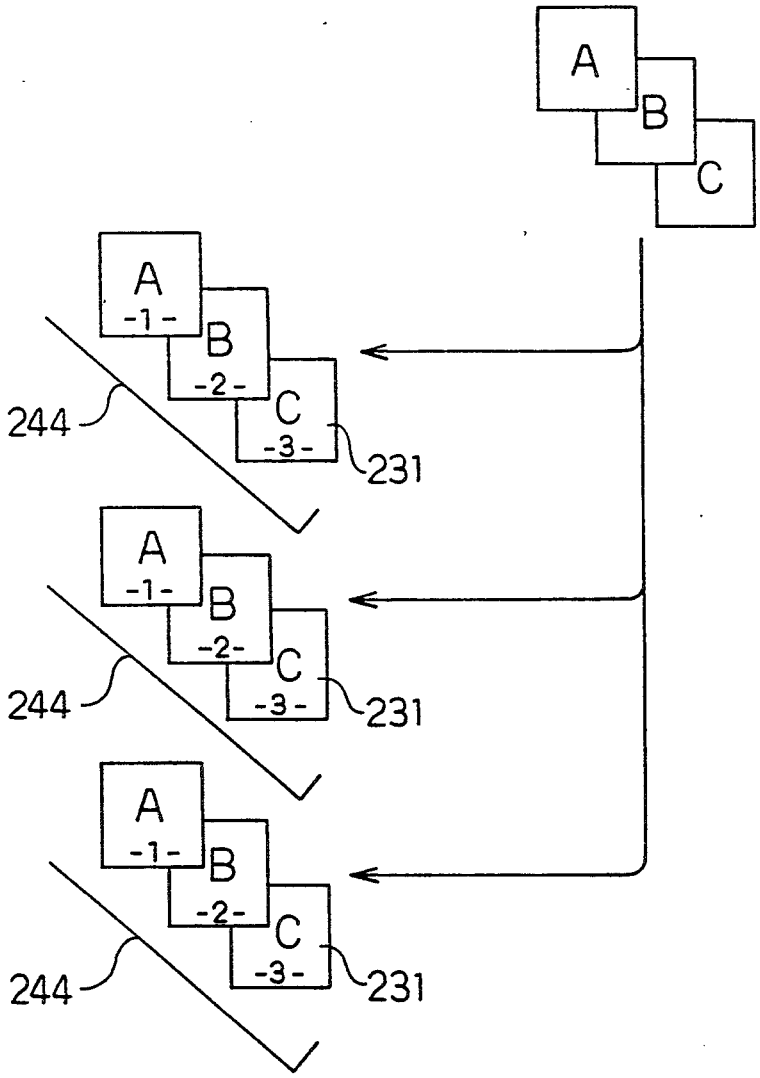
FIG. 14 is a plane view showing executed state of a page writing mode of the present invention.

The page writing is such mode that page numbers are added to the copied papers. For example, as shown in FIG. 14, when three pieces of the manuscripts are copied by three pre-set pieces, the copied papers added respectively with page number are discharged to each bins 244. Therefore if the sort mode is not executed under the page writing mode, the page writing becomes random. Thus, it is convenient that the sort mode is automatically set when the page writing mode is selected.

Figure 15:
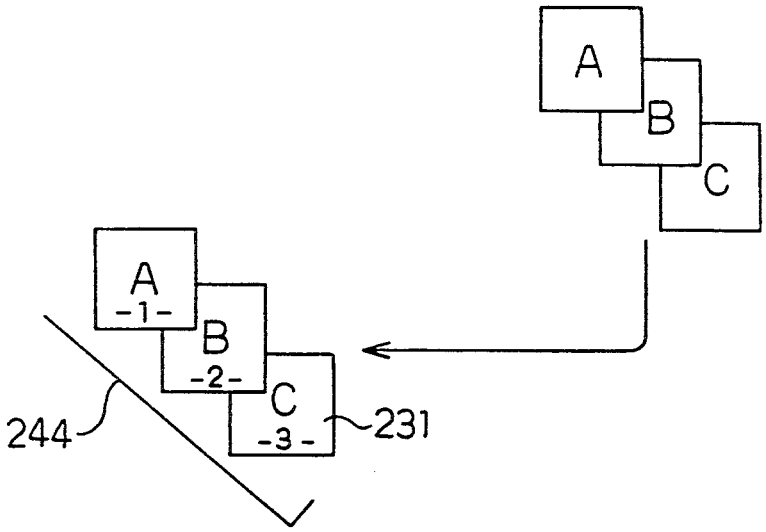
FIG. 15 is a plane view showing another executed state of the page writing mode of one present invention.

FIG. 15 shows the state that the pre-set number is 1 and the manuscript is copied under the page writing mode. In the case, all copied papers are discharged to the uppermost bin 244 in the FIG. 10 by the sort mode.

In FIG. 8, a sort instructing means 203 is such means for instructing the sort mode to the sorter 204 on the basis of the judging of the judging means 202 when the sort mode is indispensable.

The judging means 202 and the sort instructing means 203 are usually realized by utilizing a CPU (central processing unit), RAM, ROM memory with software. In FIG. 8, 206 and 207 are I/O ports dealing with the output and the input of the CPU. 208 indicates a driver for supplying the output of the I/O port 207 to the mode instructing means 201 and the motor, clutch, solenoid 209 etc. of the primary part of the image forming apparatus.

Figure 16:
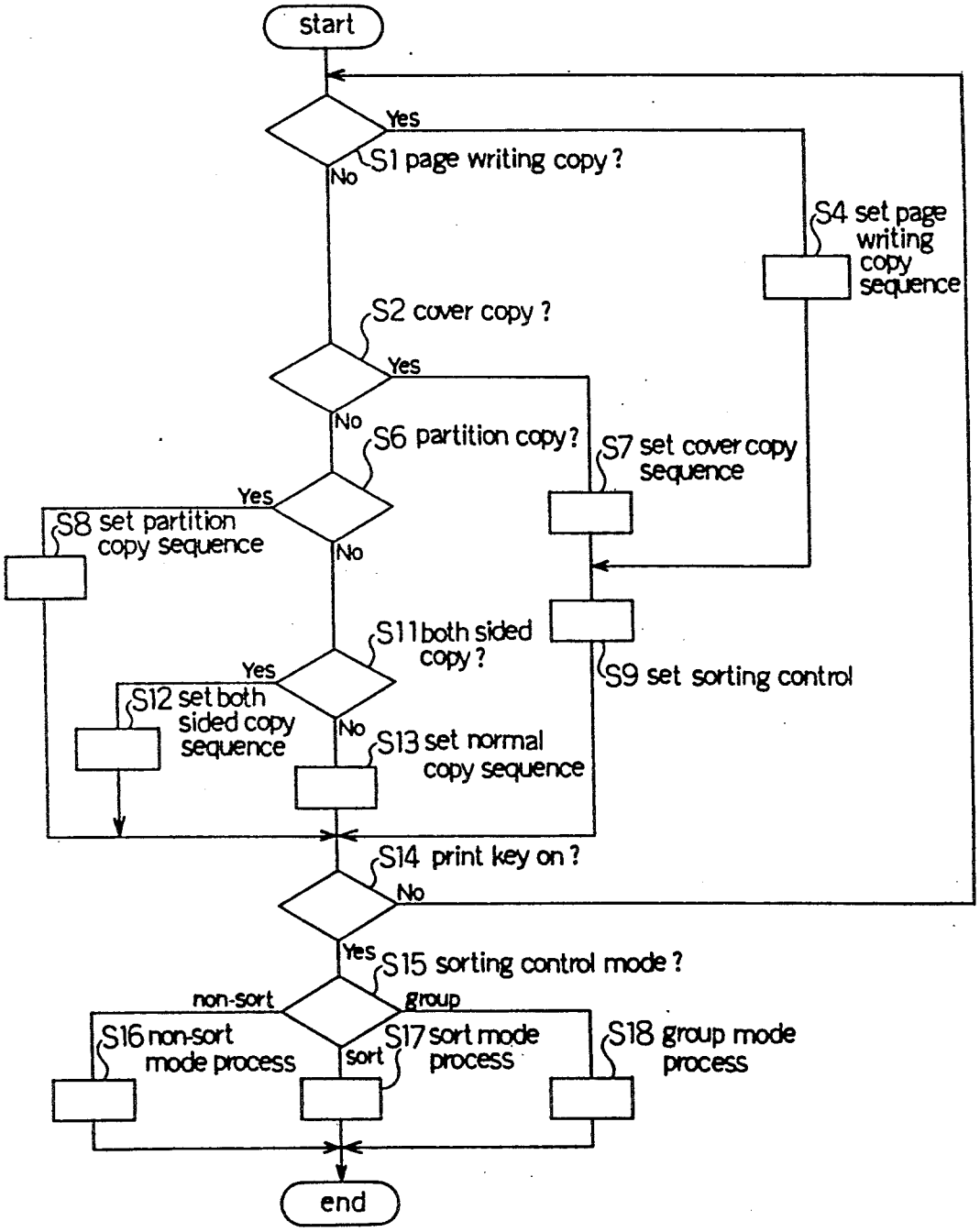
FIG. 16 is a flowchart showing the operation of the embodiment of the present invention.

Hereinafter the operation of the embodiment is described by utilizing a flowchart of FIG. 16.

The operator instructs a particular kind of mode by using the mode instructing means 201 on the console 205. The instructed signal from the mode instructing means 201 is applied to the judging means 202.

The judging means 202 judges whether the instruction is the page writing mode or not (step s1). When the instruction is the page writing mode, the page writing copy sequence is set by a known method (step s4) and the sort mode is automatically set (step s9).

On the contrary, when the instruction is not the page writing mode (step s1), the judging means 202 judges whether the instruction is the cover copy mode or not (step s2). When the instruction is the cover copy mode, the cover copy sequence is set by a known method (step s7), and the sort mode is automatically set (step s9).

When the instruction is also not the cover copy mode (step s2), the judging means 202 judges whether or not the instruction is the partition copy mode (step s6). When the instruction is the partition copy mode, a partition copy sequence is set by a known method (step s6, s8).

When the instruction is also not the partition copy mode (step s6), the judging means 202 judges whether the instruction is the both sided copy mode or not (step s11). When the instruction is the both sided copy mode, a both sided copy sequence is set by a known method (step s11, s12).

When the instruction is also not the both sided copy mode(step s11), the judging means 202 sets a normal copy sequence by a normal method(step s13).

Thus when the copy sequence according to the various kinds of the instruction is set and the print key 210 for starting the copy operation is pushed (step s14), the primary part 2000 of the image forming apparatus judges whether or not the sort mode is set (step s15). When the sort mode is set, the copy is executed under the sort mode (step s17). When the group mode is set by the mode exchange key 258, the copy is executed under the group mode(step s18). When the sort mode is not automatically or manually set, and the group mode is not manually set, the copy is executed under the non-sort mode (step s16).

The kinds of the mode automatically setting the sort mode, the mode to be predetermined, are not restricted to the above-mentioned cover copy mode and the page writing mode.

As mentioned above, the image forming apparatus of the present invention has the judging means for judging whether the copy mode instructed by the operator necessitates the sort mode control or not. Therefore, the operator can automatically execute the sort mode by only instructing the mode necessitating the sort mode, namely, without the operation of the sort mode key on the console 205. And there is not such inconvenience that the sort mode is automatically executed in spite of operator's instructing of the mode not necessitating the sort mode.

Hereinafter is described an image forming apparatus of another embodiment present invention.

Figure 18:
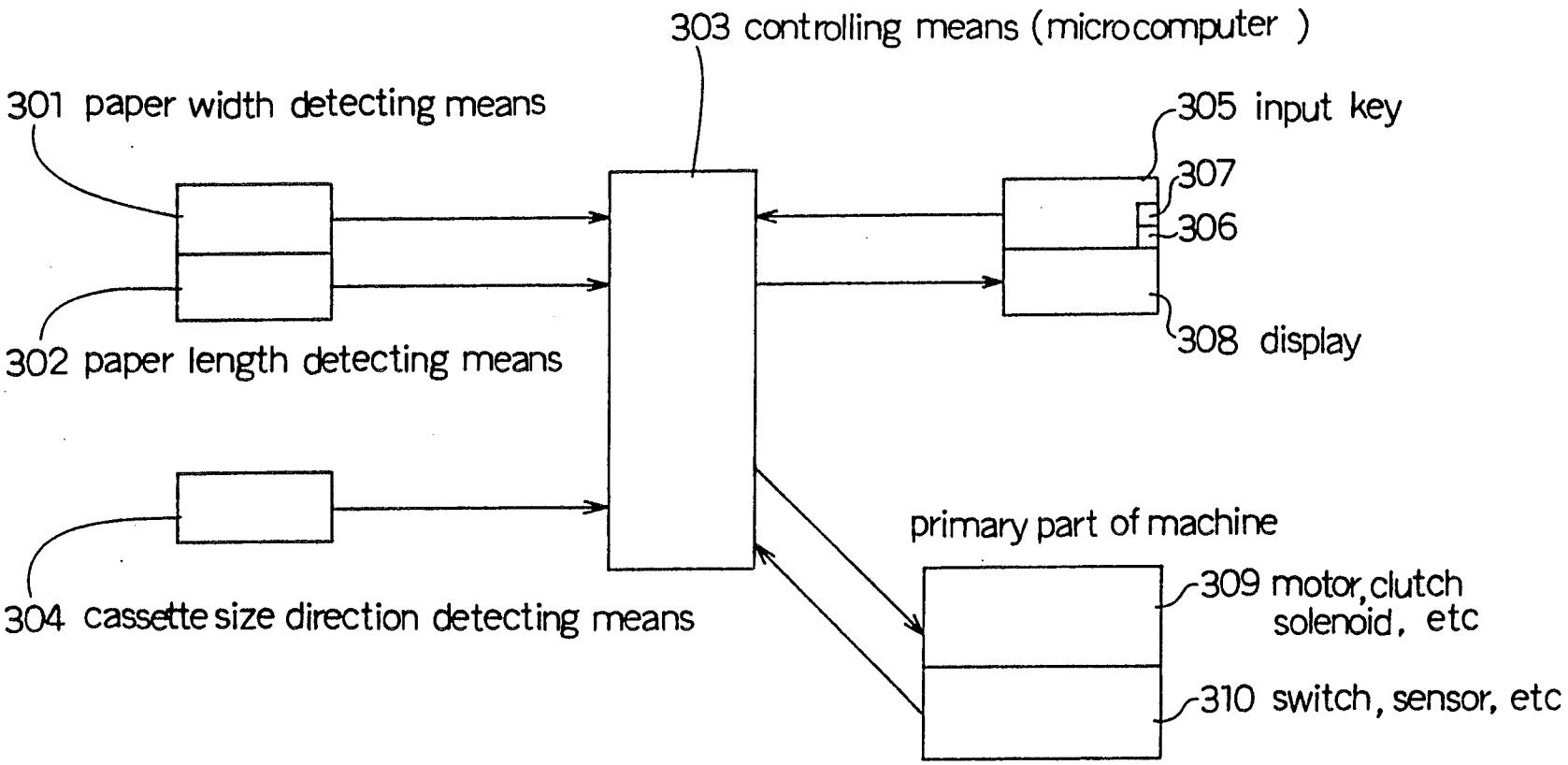
FIG. 18 is a block diagram showing a mechanism of an embodiment of the OHP paper copying machine of the present invention.

FIG. 18 is a block diagram of an OHP copying machine of an embodiment of the present invention. FIGS. (a), (b) are flowcharts showing an operation of the OHP copying machine.

The below-mentioned apparatus is only an embodiment of the present invention, and therefore does not restrict the scope of the present invention. For example, in the following embodiment, the OHP paper is supplied from a manual feeder (manual bypass feeder) but it is possible that the OHP paper is supplied from a normal paper cassette.

The hardware constitution of the OHP copying machine is described as follows.

A sheet size detecting means comprises a paper width detecting means 301 and a paper length detecting means 302, and the detected signals of the paper width detecting means 301 and the paper length detecting means 302 are applied to a controlling means 303 comprising a microcomputer.

The paper width detecting means 301 comprises, for example, a limit switch for detecting a widthwise position of a known slidable width control guide set on the manual feeder. The paper length detecting means 302 comprises, for example, a known sheet length detecting means for detecting a tail end of the paper set in the manual feeder.

In the embodiment, it is necessary to select such cassette having the same size and carrying direction as the size and direction detected by the paper width detecting means 301 and the paper length detecting means 302. For realizing the selection, the controlling means 303 detects signals from a cassette size and direction detecting means 304 which detects and outputs a cassette size and direction signal of a cassette.

The cassette size and direction detecting means 304 is respectively set in each cassette of a copying machine having plural paper cassettes. For example, the cassette size direction detecting means 304 comprises a detecting device attached to the primary part of the copying machine and a particularly formed piece attached to the paper cassette. The shape of the piece is formed corresponding to the size and direction of each paper cassette. The detecting device detects the shape of the piece, thereby to recognize the size and direction of the cassette.

Further, an operation means 305, such as a console, is connected to the control means 303. The operation means 305 comprises, for example, a print key 306, an OHP paper copy mode key 307 for setting the OHP paper copy mode and a display 308 for displaying a present mode, a copy number, etc.

The controlling means 303 sends control signals to various kinds of actuators at the primary part of the copying machine, thereby to drive the same, and receives signals output from a detecting part 310 of a switch and a sensor etc. for detecting the operating states of the actuator. The actuator 309 includes the manual feeder and a paper supply clutch set on a paper supplying part set with the paper cassette. The actuator 309 carries the OHP paper and the paper from the selected paper cassette.

Hereinafter the operation of the OHP copy process is described by using FIGS. 19(*a*), (*b*).

Meanwhile s1, s2, . . . indicate the number of steps(-processes) in the following description.

Before the copying process, the operator sets the OHP copy mode by pushing the OHP paper copy mode 307.

Then, when the mode is the OHP copy mode in the step s1, it is judged whether or not OHP paper is set in the manual feeder in the step s2. Such judging is executed by the known paper detecting switch such as a limit switch, an optical sensor etc., set in the manual feeder. When there is no OHP paper, a display to arouse operation's attention to set the OHP paper in the manual feeder is made on the display part 8(step s3).

When the OHP paper is set in the manual feeder, the width of the set OHP paper is judged by using the signal from the paper width detecting means 301 in the steps s4–s8. When the detected width agrees to the width of A3 paper longitudinally carried, the length of the OHP paper is judged by using the signal of the paper length detecting means 302 in the step s9. When the length in the carrying direction is as same as the length of the A3 paper, it is confirmed that the size of the supplied OHP paper is A3 and the OHP paper is longitudinally carried(step s10). Then the A3 process for selecting the A3 size paper is executed(step s11).

When the length in the carrying direction of the OHP paper is not A3 length, it is judged that the OHP paper is A4 paper (step s12), and an A4 process for selecting the cassette which can laterally carry the A4 paper is executed (step s13).

When the width of the set OHP paper is the width (short side length) of the B4 paper longitudinally carried (step s5), it is judged whether or not the length in the carrying direction of the OHP paper agrees to the length (long side length) of the B4 paper on the basis of the signal from the paper length detecting means 302. When both lengths are equal, it is confirmed that the OHP paper is B4 and the OHP paper is longitudinally carried. Then the B4 process is executed (step s15, s16). On the contrary, when the length in the carrying direction of the OHP paper is not equal to the length (long side length), it is confirmed that the OHP paper is B5 paper (laterally carried) (step s17), and the B5 process is executed (step s18).

When the width of the OHP paper agrees to the width of the A4R paper(A4 paper is longitudinally carried), the A4R process is executed in step s19, step s20, and when the OHP paper is judged as B5R (B5 paper is laterally carried), the B5R process is executed in step s21, step s22. Further, when the OHP paper is judged as A5R (A5R paper is longitudinally carried), the A5R process is executed in step s23, step s24.

When such width out of the standard size is detected in the steps s4–s8, the size of the OHP is judged as out of the standard in the step s25. The display 308 displays size indefinite information.

As mentioned above, the OHP paper copying machine of the embodiment can deal with the 7 standards of A3, A4, B4, B5, A4R, B5R, A5R.

Figure 19:
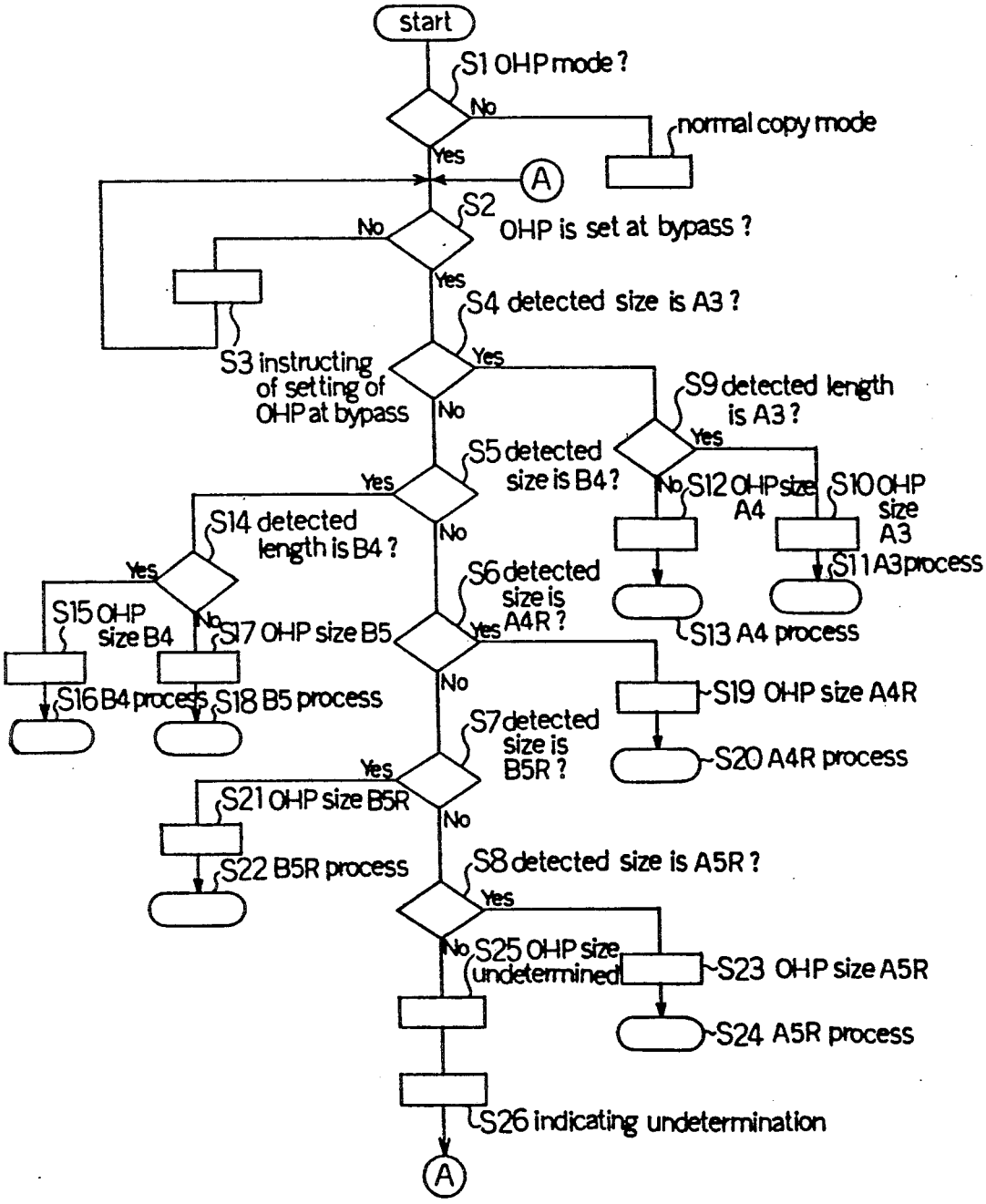
FIGS. 19(*a*) and 19(*b*) are flowcharts showing the operation of the present invention.
Figure 19:
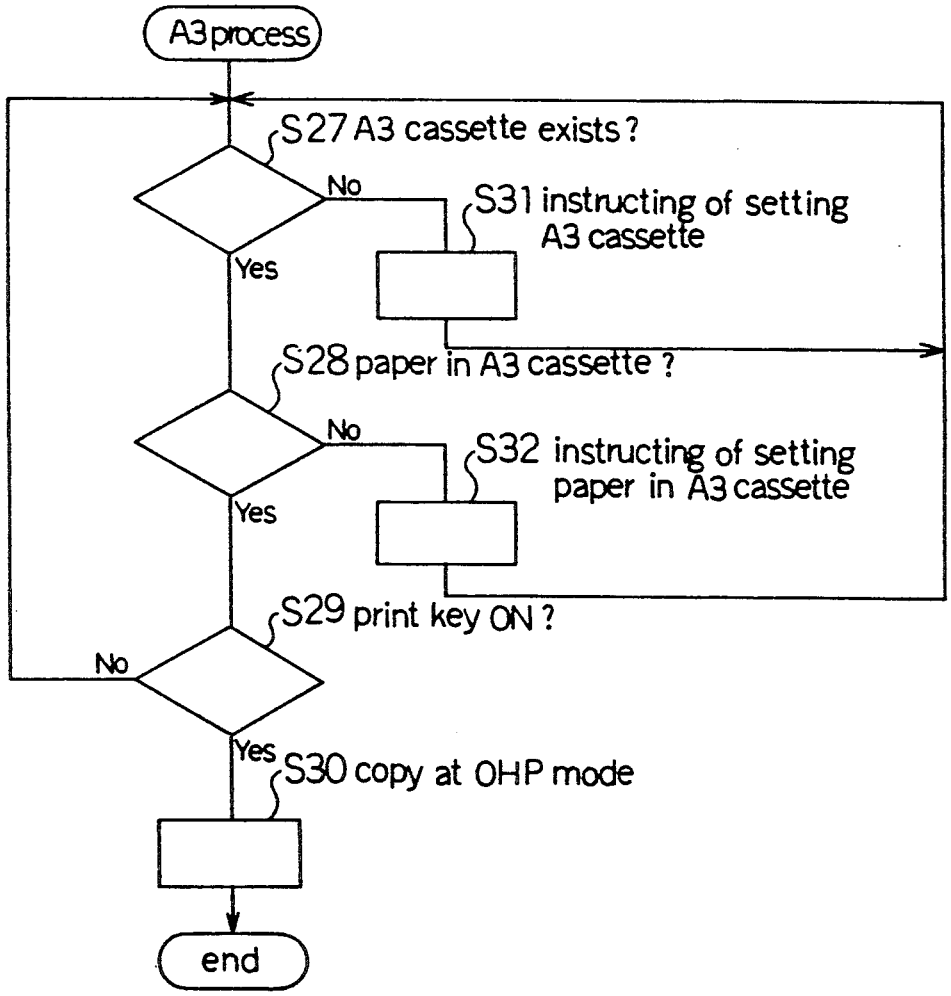
Figure 20:
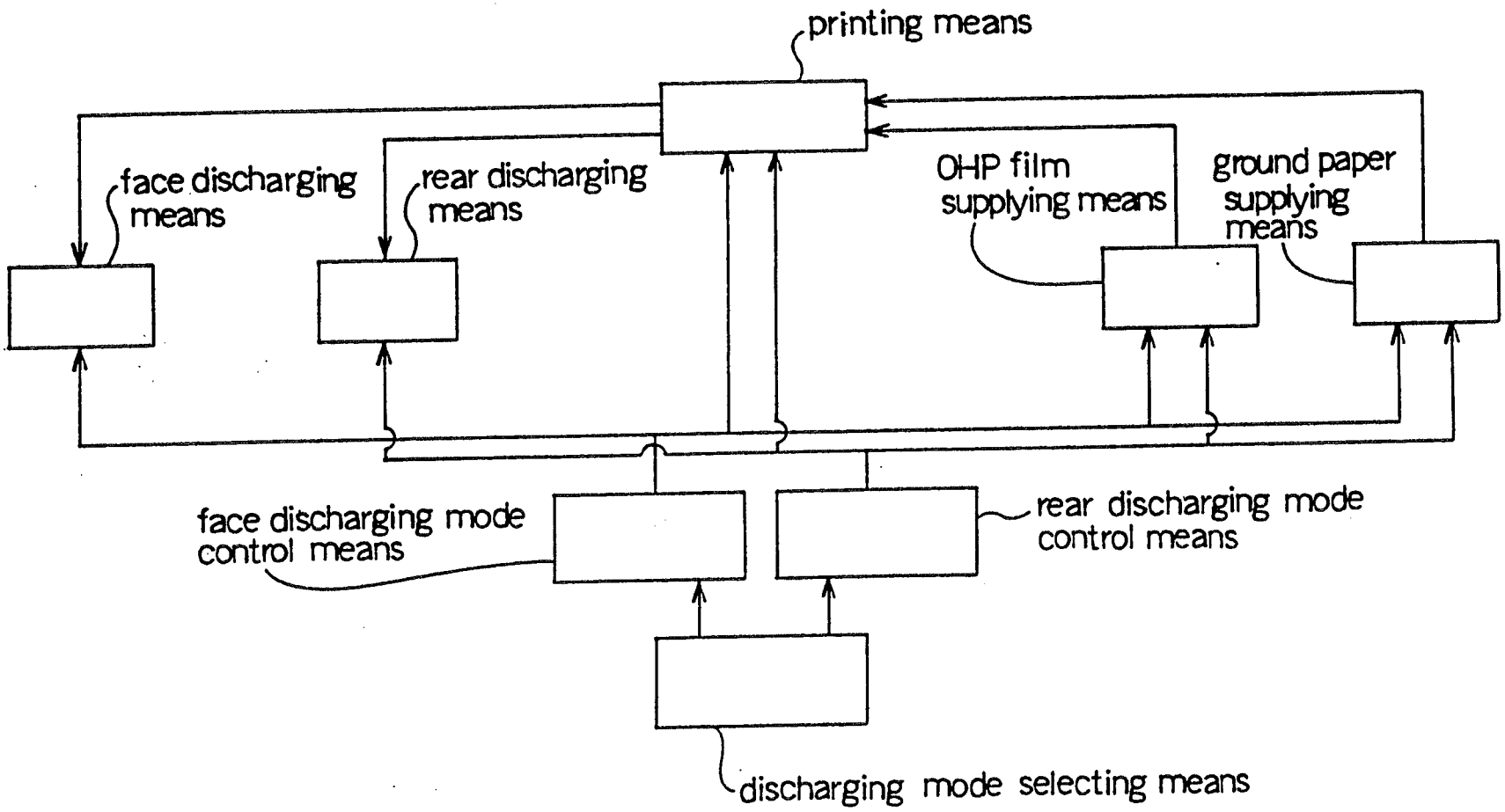
FIG. 20 is a block diagram showing the function of an embodiment of another image forming apparatus of the present invention.

The copying process after the size and direction detecting process is described on the basis of FIG. 19 (*b*). FIG. 19(*b*) only shows the A3 process executed when the OHP paper is A3 and longitudinally carried in steps s10 and s11. When other sizes and directions are judged, a similar process corresponding to the size and direction is executed.

As shown in FIGS. 19(*b*), the A3 process starts from the judging (step s17) to which place the paper cassette capable of longitudinally carrying the A3 paper is set. The judging with regard to A3 cassette mounting is executed by scanning the signals from the cassette size and direction detecting means 304 in FIG. 18. When the A3 cassette is set, such judging is executed whether or not A3 longitudinal carried papers are set in the cassette, on the basis of the signal from a paper detecting means for checking whether or not there are papers in the cassette (step s28).

When the papers are set in the cassette, the copy process under the OHP paper copy mode is executed by the pushing of the print key 307 (steps s29, s30). Such copy processes in the step s30 comprises a process wherein papers and OHP papers are alternately taken out in this order from the paper supplying means (the second paper supplying means) set with the selected paper cassette and from the paper supplying means (first paper supplying means) and from the manual feeder, and at least the OHP papers are copied. Of course the papers may also be copied.

When the A3 longitudinal carrying paper cassette is not set in the selected paper supplying means in the step s27, the display 8 displays the instruction to the operator to set the A3 longitudinal carrying paper cassette in the step s30.

When the papers are not set in the paper cassette in the step s28 the display 8 displays the instruction to the operator to set the A3 paper (step s32).

As mentioned above, the present invention comprises;

paper size detecting means for detecting size and direction of an OHP paper supplied from an instructed first paper supplying means, paper supplying means selection means for selecting a second paper supplying means in which a paper cassette is set, the cassette having a paper of the same size and same direction as the size and direction detected by the paper size detecting means, and copying means for copying at least the OHP paper, by alternately supplying the OHP paper and the paper from the first paper supplying means and the second paper supplying means. Therefore, papers having the same size and same direction as the supplied OHP papers are supplied. As a result, it is not necessary to cut the paper to arrange the paper size after copying and to arrange the direction of the papers. Thus the operation is efficiently executed.

Hereinafter an image forming apparatus of another embodiment of the present invention is described.

Figure 21:
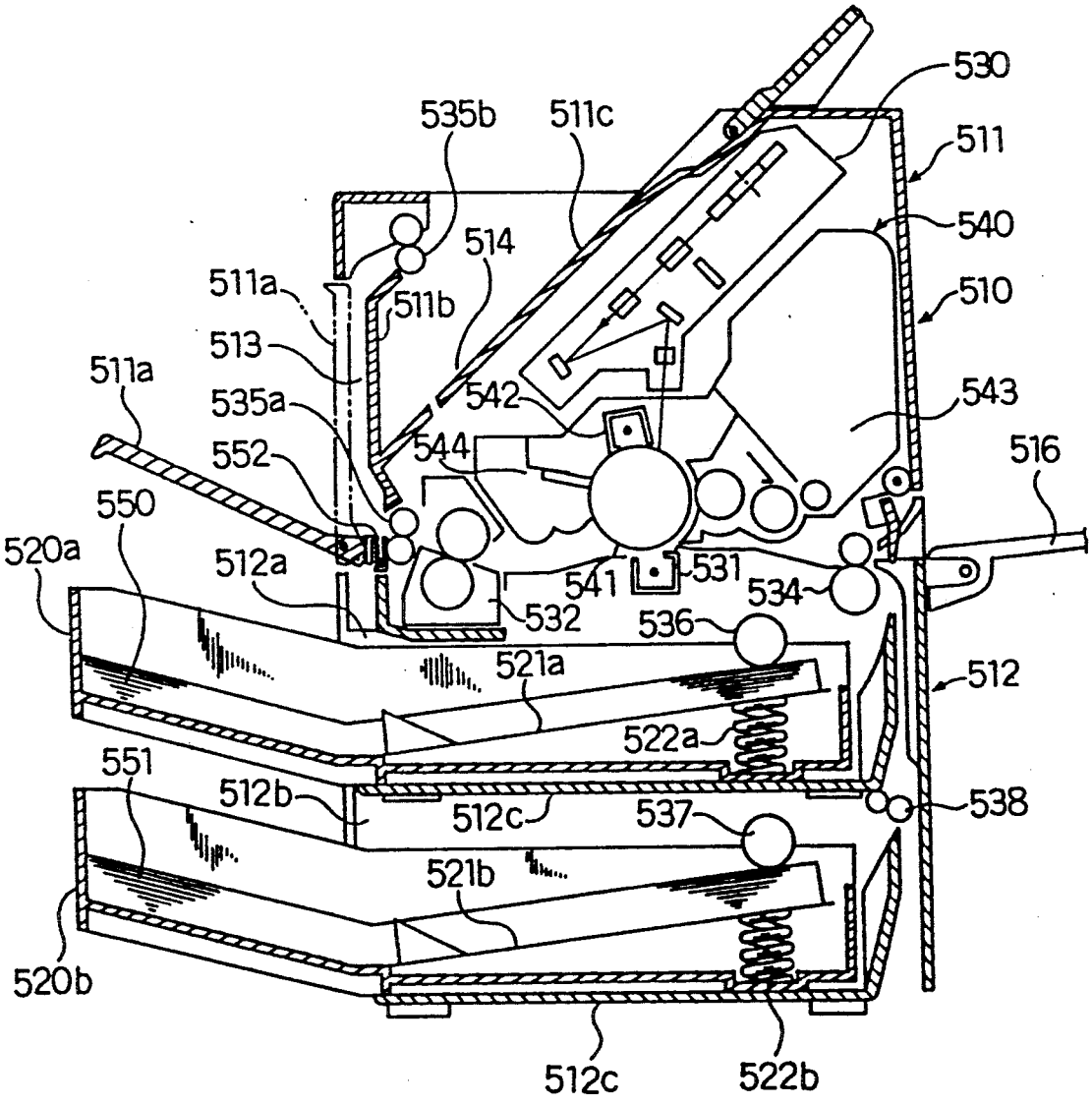
FIG. 21 is a section view showing a laser printer of an embodiment of an present invention.

FIG. 21 is a section view showing a laser printer of an embodiment of the present invention. In FIG. 21, a primary frame 510 comprises an upper frame 511 and an lower frame 512, and these frames 511, 512 are relatively rotatable around a pivot of a paper supplying part of the laser printer.

At the left side of the upper frame 511, a discharge tray 511*a* is rotatably attached. The discharge tray 511*a* receives the copied papers when the copied papers are discharged with the printed surface upwards (hereinafter referred as "face discharge"). When the copied papers are discharged with the printed surface downwards (hereinafter referred as "rear discharge"), as shown by a two-dots chain line, the discharge tray 511*a* becomes a side wall of the upper frame 511 and forms a paper carrying passage 513 with a guide 511*b* in the upper frame 511. A discharge tray 514 for the rear discharge is formed by the guide 511*b* and an upper wall 511*c* of the upper frame 511.

At a bottom part of the lower frame 512, one pair of cassette inlets 512*a*, 512*b* is formed with upper and down steps. In the lower frame 512, one pair of cassettes 520*a*, 520*b* inserted from the cassette holders 512*a*, 512*b* are disposed. The cassettes 520*a*, 520*b* are mounted on base parts 512*c* of the lower frame 512. Each cassette 520*a*, 520*b* has set plates 512*a*, 512*b* and spring 522*a*, 522*b*. In the cassette 520*a*, for example, many pieces of the OHP papers 550 are set one over one. And in the cassette 520*b*, for example, many pieces of the normal papers 551 are set one over one. A manual paper tray 516 is foldably attached to a upper and right side wall (from the view point of the figure) of the lower frame 512. In the printer, an optical system 530 including a laser oscillator, not shown in the FIG. 25, is disposed. The optical system 530 has a rotatable polygon mirror for scanning a laser light on a photo-sensitive drum 541 and various kinds of lenses for compensation of inclination of the axis of the polygon mirror and for compensation of focus lag. In the central position of the printer, there is a process unit 540 which includes photo-sensitive drum 541 on which electrostatic latent images are formed with exposure to the optical system 530, corona main discharging means 542 for charging the surface of the photo-sensitive drum 541 with certain electricity, developing means 543 for developing the latent image, and cleaning means 544 for cleaning up remaining electricity and remaining toner on the photo-sensitive drum 541.

Under the photo-sensitive drum 541, a corona discharging means (transcribing means) 531, for transcribing toner image to a paper, is disposed with a certain distance against the photo-sensitive drum 541.

A paper supplying roller 536 for carrying the OHP paper 550 in the paper cassette 520*a* out to the paper carrying passage, is disposed above a paper supplying side edge of the paper cassette 520*a* set in the cassette inlet 512*a*. A paper supplying roller 537 and a sub paper supplying roller 538 for carrying out the normal paper 551 in the paper cassette 520*b* to the paper carrying passage, is disposed above a paper supplying side edge of the paper cassette 520*b* set in the cassette inlet 512*b*. A resist roller 534 for supplying the paper to an image forming means (transcribing means) with a certain time distance, is disposed in the paper carrying passage.

Under a downstream position of the image forming means, a fixing apparatus 532 and a first discharge rollers 535*a* are disposed. Above the discharge rollers 535*a*, a second discharge rollers 535*b* for discharging papers on the discharge tray 514 at the rear discharge, is disposed. A switch 552 for judging whether the discharge tray 511*a* is for the face discharge (indicated by a real line) or is for the rear discharge (indicated by two dots chain line), is disposed at the root position of the discharge tray 511*a*.

Hereinafter the operation of the embodiment is described as follows.

The schematic operation of the laser printer is as follows. In case of the cassette paper supplying, the paper is taken out to the paper carrying passage one by one from the cassette 520*a*, 520*b*. The paper is supplied to the image forming means by the resist rollers 534 by the certain time distance.

On the other hand, laser light is emitted from the laser oscillator in the optical system 530 according to the image information from the host computer etc. The laser light is irradiated on the photo-sensitive drum 541 by the rotation of the polygon mirror and so on. Then the electrostatic latent image corresponding to the image information is formed on the photo-sensitive drum 541. The electrostatic latent image is developed by the developing means 543, and is transcribed to the paper carried above the corona discharging means 531. The toner image transcribed on the paper is fixed by the fixing apparatus 532 and the paper is discharged by the discharge rollers 535*a*. When the discharge tray 511*a* is at the face discharge (real line state), the paper is put on the discharge tray 511*a* with the copied surface upwards. When the discharge tray 511*a* is at the rear discharge (two dots chain line state), the paper is carried through the discharge carrying passage 513 and is put on the discharge tray 514 with the copied surface downwards.

Generally classifying, there are two print modes available with the laser printer. One mode is a normal copy mode wherein the normal paper in the cassette 520*b* is copied by the above operation. The remaining mode is an OHP copy mode wherein the OHP paper in the cassette 520*a* is copied by the above operation. The OHP copy mode is a mode to copy only the OHP paper 520 or a mode to copy the OHP paper using the normal paper 551 as a ground sheet. The latter mode is a mode to also copy the ground sheet or a mode not to copy the ground sheet. These modes are selected beforehand by the operator's operation of keys on a console not shown in the figure. The switch 552 detects the state of the discharge tray 511*a*, and thereby the face discharge mode and the rear discharge mode are set.

Figure 22:
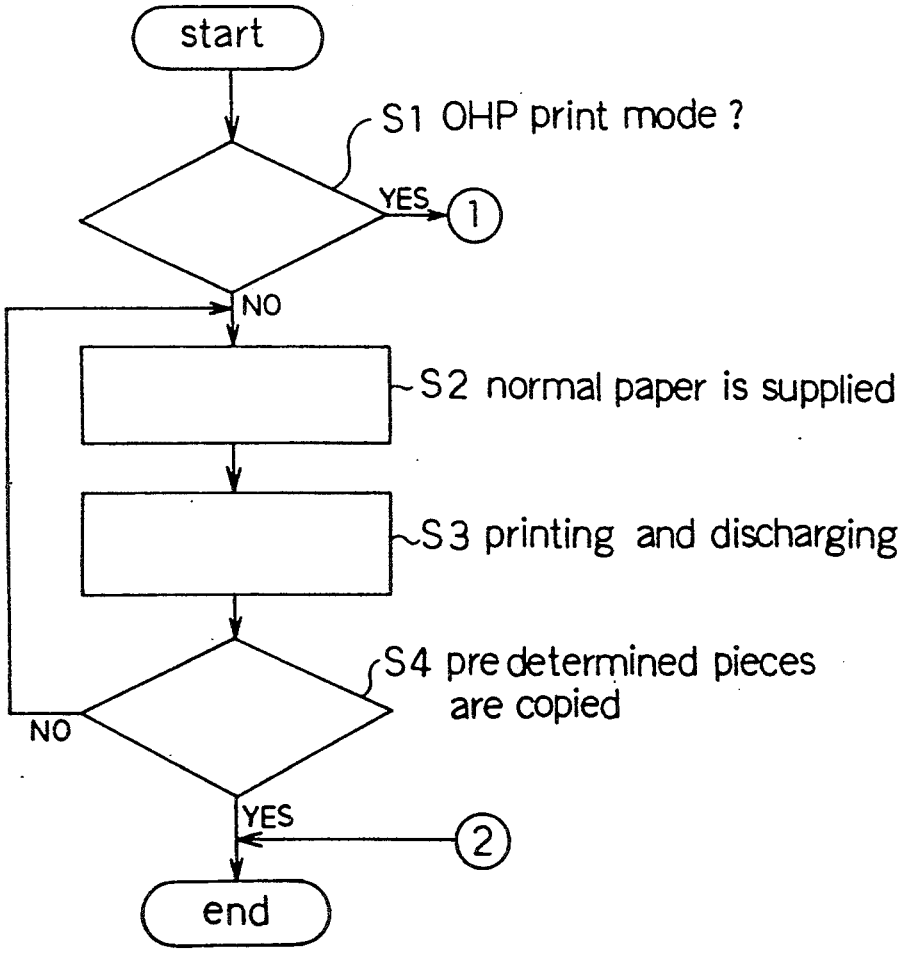
FIGS. 22 and 23 are flowcharts showing the operation of the laser printer of an embodiment of the present invention.
Figure 23:
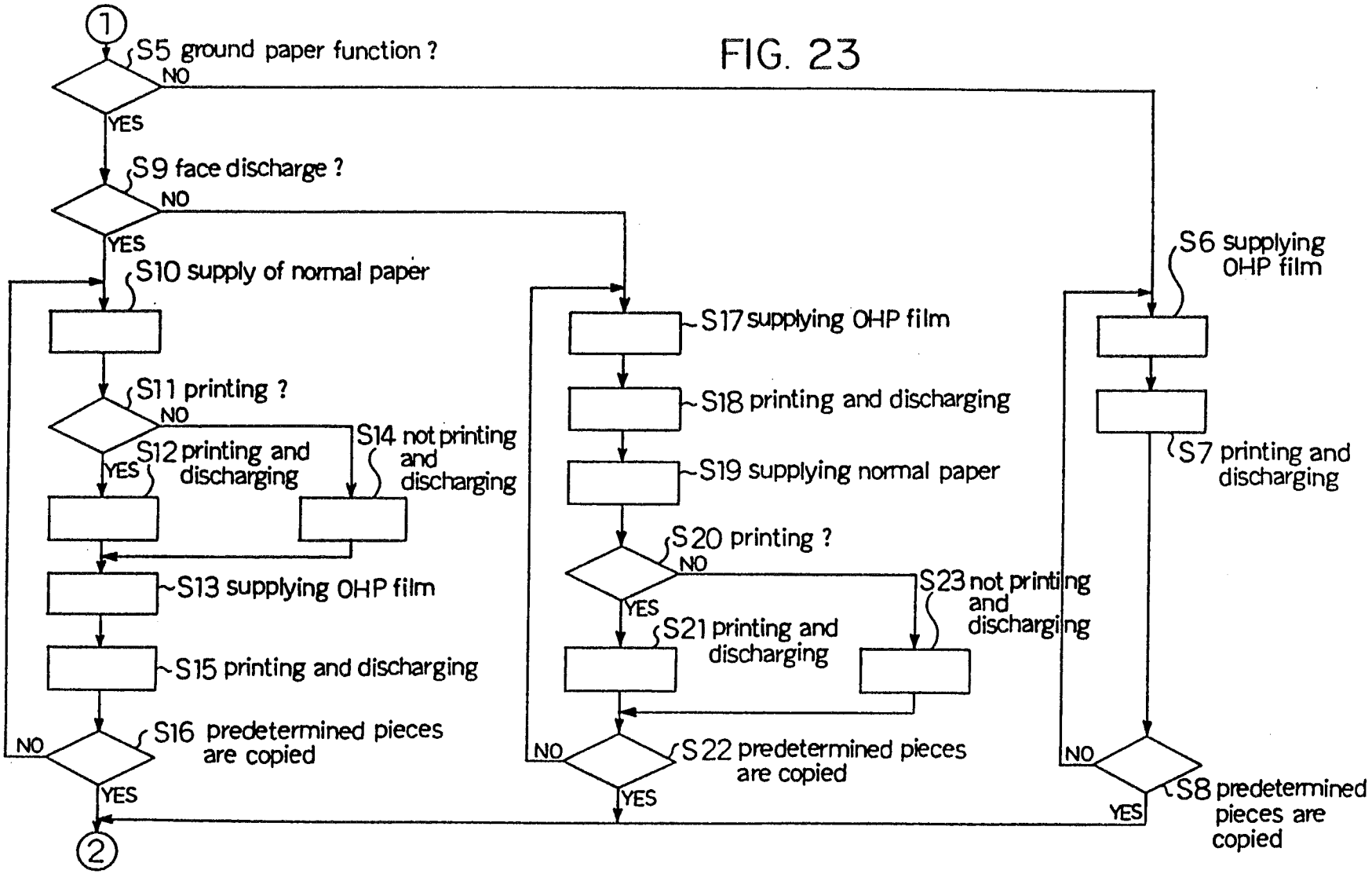

When copying, the laser printer responds to the set mode as shown in FIGS. 22, 23.

First, under the normal copy mode, when the judging of the step s1 in the FIG. 22 is NO, the program goes to the step s2. In step s2, the normal paper is supplied and in step s3, the paper is copied and is discharged. Next in step s4, whether or not the copying of the preset number is completed is judged. When the copied number does not reach the preset number, the operation of step s2 and step s3 are repeated. In step s4, when the copied number reaches the reset number, the copying is completed.

When the OHP copy mode is set, the judging in the step s1 is YES and the program goes to step s5 in FIG. 23. In step s5, whether or not the mode necessitating the ground sheet is set is judged. When the ground sheet is not necessary, the program goes to step s6. The OHP paper is supplied in step s6, and the OHP paper is copied and discharged in step s7. In step s8, whether or not the copied number reaches the preset number is judged. When the copied number does not reach the preset number, step s6 and step s7 are repeated.

In the OHP copy mode, when the ground sheet is necessary, the judging in step s5 is YES and the program goes to step s9. In step s9, whether the discharge mode is the face discharge mode or is the rear discharge mode is judged. When the discharge mode is the face discharge mode, the program goes to step s10. In step s10, the normal paper is supplied. And in s11, whether or not the normal paper is to be copied is judged. When the ground sheet is to be copied, the judging is YES and the program goes to step s12. In step s12, the normal paper is copied with the same image as the copy of the corresponding next OHP paper and the program goes to step s13. On the contrary, in step s11, when the normal paper is not to be copied, the program goes to step s14. In step s14, the supplied normal copy is not copied and discharged, and the program goes to step s13. In step s13, the OHP paper is supplied and in step s15 the OHP paper is copied and discharged. Thus the OHP paper and the normal paper are discharged to the discharge tray 511*a* (FIG. 21) and are stacked in order, with the copied surface upwards. That is, the ground sheet is discharged at the rear side of the corresponding OHP paper. Next, in step s16, whether or not the copied number reaches the preset number is judged. When the copied number does not reach the preset number, steps s10–s15 are repeated. In step s16, when the copied number reaches the preset number, the copying is completed.

When the discharge mode is the OHP copy mode and the rear discharge mode, and the ground sheet is necessary, the program goes to step s17 from step s9. In step s17, the OHP paper is supplied and in step s18 the OHP is copied and discharged. In step s19, the normal paper is supplied. Next in step s20, whether or not the normal paper is to be copied is judged. When the normal paper is to be copied, the judging is YES and the program goes to step s21. In step s21, the supplied paper is copied with the same image as the corresponding OHP paper and the program goes to step s22. On the contrary, in step s20, when the normal paper is not to be copied, the program goes to step s23. In step s23, the normal paper is not copied and discharged, and the program goes to step s22. In this case, the normal copy and the OHP paper are discharged to the discharge tray 514 (FIG. 21) and are stacked in order with the copied surface downwards. That is, the ground sheet is discharged at the rear side of the corresponding OHP paper. Next in s22, whether the copied number reaches the preset number or not is judged. When the copied number does not reach the preset number, steps s17–s23 are repeated. When the copied number reaches the preset number, the copying is completed.

The present invention is applicable not only to the above-mentioned laser printer, but also to other image forming apparatus such as a copying machine. In the embodiment, when a normal paper is set in the paper cassette 520*a*, the printer can be used as a normal printer. And the present invention is applicable to an exclusive image forming apparatus for the OHP paper. The present invention can be applicable to such image forming apparatus necessitating the ground paper. Further the present invention can be applicable to the image forming apparatus in which the exchanging of the mode with regard to the copying of the ground sheet cannot be executed.

As mentioned above, in the image forming apparatus of the present invention, the ground sheet is disposed at the rear side of the corresponding OHP paper whether the mode is the face discharge mode or not. That is, in any discharge mode, the ground sheet is not discharged on the copied surface of the OHP paper, and thereby the function of the ground sheet is not damaged.

Although the invention has been described in its preferred form with a certain degree of particularity, it is understood that the present disclosure of the preferred form can be changed in the details of construction and the combination and arrangement of parts may be restored too without departing from the spirt and the scope of the invention as hereinafter claimed.

We claim:

1. An image forming apparatus, comprising:

paper supply means;

a sorter having a non-sort mode and a sort mode;

copying means for copying an image onto a paper supplied from said paper supply means and for forwarding the paper to said sorter following the copying of an image onto said paper, said copying means having a cover copy mode, a page numbering copy mode, and at least one other copy mode;

a mode instructing means for instructing said copying means to be in either said cover copy mode, page numbering mode or other copy mode;

judging means for judging whether said mode instructing means is instructing said copying means to be in the cover copy mode, page number copy mode or other copy mode;

sort instructing means in communication with said judging means and said sorter, said sort instructing means instructing said sorter to be in a sort mode when said judging means judges that said mode instructing means is instructing said copying means to be in the cover copy mode or the page numbering copy mode.

2. An image forming apparatus, comprising:

first paper supplying means for supplying transparent overhead projector paper;

transparent paper size detecting means for detecting size and direction of the overhead projector paper being supplied by said first paper supplying means;

second paper supplying means having a plurality of different cassettes for different size and direction paper;

selection means for selecting one of the cassettes of the second paper supplying means holding the same size and direction paper as the size and direction of the overhead projector paper detected by said transparent paper size detecting means; and copying means for copying an image onto at least the overhead projector paper supplied by said first paper supplying means, and said copying means including means for drawing in sequential fashion paper from said first and second paper supplying means.

3. An image forming apparatus, comprising;

paper supply means, said paper supply means including a first tray for holding transparent overhead projector paper and a second tray for holding non-transparent paper;

image developing means for developing an image on a paper supplied from said paper supply means;

a sorter having a non-sort mode and a sort mode;

discharge means for passing a paper from said image developing means to said sorter;

transparent paper image forming instructing means for directing said paper supply means to pass, in sequence, a paper from said first tray and from said second tray;

sorter instructing means for instructing said sorter to be in a non-sort mode or a sort mode;

a console having means for manually signaling said sorter instructing means to position said sorter in said non-sort mode or sort mode, said console further comprising means for manually activating said transparent paper image forming instructing means;

detecting means for detecting the presence of transparent overhead projector paper in said paper supply means;

said sorter instructing means including non-sort instructing means in communication with both said transparent paper image forming instructing means and said detecting means such that said sorter instructing means sets said sorter in a non-sort mode whenever said transparent paper image forming instructing means is manually activated by said means for manually activating said transparent paper image forming apparatus, whenever said detecting means detects the presence of transparent overhead paper, and whenever said manual signaling means signals said sort instructing means to position said sorter in a sort mode but said detecting means senses the presence of the transparent overhead paper.

4. An image forming apparatus as recited in claim 3, wherein said detecting means includes a light emitter and receiver with one positioned above and one positioned below said first and second trays such that light passing through a transparent overhead projector paper is detected by said detection means.

5. An image forming apparatus as recited in claim 4, wherein said image forming apparatus further comprises a paper detection switch at a downstream end of each of said first and second trays.

6. An image forming apparatus as recited in claim 3 wherein said detection means includes a light emitter and a light receiver positioned downstream in paper passage direction of said first and second trays and upstream of said developing means.

7. An image forming apparatus of the present invention comprising;

printing means for printing an image on a supplied paper,

OHP paper supplying means for supplying an OHP paper to said printing means, ground paper supplying means for supplying a ground paper to said printing means, face discharging means for discharging and stacking papers printed by said printing means with the printed surface upwards, rear discharging means for discharging and stacking papers printed by said printing means with the printed surface downwards, discharging mode selecting means for selecting a discharge mode among said face discharging mode and said rear discharging mode, face discharging mode control means for controlling said OHP paper supplying means, said ground paper supplying means and said face discharging means in a manner that first the ground paper is discharged and next the OHP paper is discharged to said printing means when said face discharging mode is selected by said discharging mode selecting means, and rear discharging mode control means for controlling said OHP paper supplying means, said ground paper supplying means and said rear discharging means in a manner that first the OHP paper is discharged and next the ground paper is discharged to said printing means when said rear discharging mode is selected by said discharging mode selecting means.

* * * * *